US010347089B2

(12) United States Patent
Meyerhofer et al.

(10) Patent No.: US 10,347,089 B2
(45) Date of Patent: Jul. 9, 2019

(54) VARIABLE SKILL REWARD WAGERING SYSTEM

(71) Applicant: Gamblit Gaming, LLC, Glendale, CA (US)

(72) Inventors: Eric Meyerhofer, Pasadena, CA (US); Bryce Cire, Los Angeles, CA (US); Julian Volyn, Studio City, CA (US)

( * ) Notice: Subject to any disclaimer, the term of this patent is extended or adjusted under 35 U.S.C. 154(b) by 0 days.

(21) Appl. No.: 15/470,869

(22) Filed: Mar. 27, 2017

(65) Prior Publication Data

US 2017/0278355 A1 Sep. 28, 2017

Related U.S. Application Data

(60) Provisional application No. 62/338,332, filed on May 18, 2016, provisional application No. 62/329,163, filed on Apr. 28, 2016, provisional application No. 62/320,397, filed on Apr. 8, 2016, provisional application No. 62/313,685, filed on Mar. 25, 2016.

(51) Int. Cl.
*G07F 17/32* (2006.01)

(52) U.S. Cl.
CPC ..... *G07F 17/3295* (2013.01); *G07F 17/3248* (2013.01); *G07F 17/3288* (2013.01)

(58) Field of Classification Search
CPC ..... G07F 17/32
See application file for complete search history.

(56) References Cited

U.S. PATENT DOCUMENTS 5,413,357 A 5/1995 Schulze et al.
5,718,429 A 2/1998 Keller
5,785,592 A 7/1998 Jacobsen
5,853,324 A 12/1998 Kami et al.
5,963,745 A 10/1999 Collins et al.
6,050,895 A 4/2000 Luciano
6,165,071 A 12/2000 Weiss
6,227,974 B1 5/2001 Eilat
6,267,669 B1 7/2001 Luciano
6,685,563 B1 2/2004 Meekins et al.
6,712,693 B1 3/2004 Hettinger
(Continued)

OTHER PUBLICATIONS

U.S. Appl. No. 14/815,764 Arnone, et al. filed Jul. 31, 2015.
(Continued)

*Primary Examiner* — Jason Skaarup
(74) *Attorney, Agent, or Firm* — Frank Cire; Caity Ross

(57) ABSTRACT

A variable skill reward wagering system is disclosed. The system includes an interactive controller that determines a skill outcome for a user while playing a skill-based game of the interactive controller, and communicate the skill outcome to a process controller. The system further includes a variable skill reward controller determines an amount of credits to add to a variable skill reward pool credit meter datastore, receive the skill outcome for the user from the process controller, and determine a variable skill reward of credits from the variable skill reward pool credit meter datastore for the user based on the skill outcome. The system further includes the process controller that receives the skill outcome from the interactive controller, communicates the skill outcome to the variable skill reward controller, and receives the variable skill reward of credits from the variable skill reward controller.

5 Claims, 15 Drawing Sheets

(56) References Cited

U.S. PATENT DOCUMENTS 6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,931,531 B2 4/2011 Oberberger
7,938,727 B1 5/2011 Konkle
7,950,993 B2 5/2011 Oberberger
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,430,735 B2 4/2013 Oberberger
8,475,266 B2 7/2013 Arnone
8,480,470 B2 7/2013 Napolitano et al.
8,622,809 B1 1/2014 Arora et al.
8,864,564 B2 10/2014 Oberberger
9,070,257 B1 6/2015 Scalise
2001/0004609 A1 6/2001 Walker et al.
2001/0019965 A1 9/2001 Ochi
2002/0022509 A1 2/2002 Nicastro et al.
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0097610 A1 5/2004 Saito
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.

(56) References Cited

U.S. PATENT DOCUMENTS

2009/0176560 A1 7/2009 Herrmann et al.
2009/0176566 A1 7/2009 Kelly
2009/0181777 A1 7/2009 Christiani
2009/0221355 A1 9/2009 Dunaevsky et al.
2009/0239610 A1 9/2009 Olive
2009/0247272 A1 10/2009 Abe
2009/0270164 A1 10/2009 Seelig
2009/0275393 A1 11/2009 Kisenwether
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0029373 A1 2/2010 Graham et al.
2010/0035674 A1 2/2010 Slomiany
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0184509 A1 7/2010 Sylla et al.
2010/0190546 A1* 7/2010 Baerlocher ..... G07F 17/32 463/20
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0285869 A1 11/2010 Walker
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gerson
2011/0045896 A1 2/2011 Sak et al.
2011/0070945 A1 3/2011 Walker
2011/0077087 A1 3/2011 Walker et al.
2011/0082571 A1 4/2011 Murdock et al.
2011/0105206 A1 5/2011 Rowe et al.
2011/0107239 A1 5/2011 Adoni
2011/0109454 A1 5/2011 McSheffrey
2011/0111820 A1 5/2011 Filipour
2011/0111837 A1 5/2011 Gagner
2011/0111841 A1 5/2011 Tessmer
2011/0118011 A1 5/2011 Filipour et al.
2011/0201413 A1 8/2011 Oberberger
2011/0207523 A1 8/2011 Filipour et al.
2011/0212766 A1 9/2011 Bowers
2011/0212767 A1 9/2011 Barclay
2011/0218028 A1 9/2011 Acres
2011/0218035 A1 9/2011 Thomas
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0263312 A1 10/2011 De Waal
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam
2012/0004747 A1 1/2012 Kelly
2012/0028718 A1 2/2012 Barclay et al.
2012/0058814 A1 3/2012 Lutnick
2012/0077569 A1 3/2012 Watkins
2012/0108323 A1 5/2012 Kelly
2012/0135793 A1 5/2012 Antonopoulos
2012/0202587 A1 8/2012 Allen
2012/0302311 A1 11/2012 Luciano
2012/0322545 A1 12/2012 Arnone et al.
2013/0029760 A1 1/2013 Wickett
2013/0131848 A1 5/2013 Arnone et al.
2013/0190074 A1 7/2013 Arnone et al.
2013/0260869 A1 10/2013 Leandro et al.
2014/0087801 A1 3/2014 Nicely et al.
2014/0087808 A1 3/2014 Leandro et al.
2014/0087809 A1 3/2014 Leupp et al.
2014/0087855 A1* 3/2014 Caputo ..... G07F 17/3258 463/26
2014/0357350 A1 12/2014 Weingardt et al.
2015/0294535 A1* 10/2015 Hightower ..... G07F 17/38 463/7

OTHER PUBLICATIONS

U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015.
U.S. Appl. No. 14/823,951 Arnone, et al. filed Aug. 11, 2015.
U.S. Appl. No. 14/823,987 Arnone, et al. filed Aug. 11, 2015.
U.S. Appl. No. 14/825,056 Arnone, et al. filed Aug. 12, 2015.
U.S. Appl. No. 14/835,590 Arnone, et al. filed Aug. 25, 2015.
U.S. Appl. No. 14/836,902 Arnone, et al. filed Aug. 26, 2015.
U.S. Appl. No. 14/839,647 Arnone, et al. filed Aug. 28, 2015.
U.S. Appl. No. 14/842,684 Arnone, et al. filed Sep. 1, 2015.
U.S. Appl. No. 14/842,785 Arnone, et al. filed Sep. 1, 2015.
U.S. Appl. No. 14/854,021 Arnone, et al. filed Sep. 14, 2015.
U.S. Appl. No. 14/855,322 Arnone, et al. filed Sep. 15, 2015.
U.S. Appl. No. 14/859,065 Arnone, et al. filed Sep. 18, 2015.
U.S. Appl. No. 14/865,422 Arnone, et al. filed Sep. 25, 2015.
U.S. Appl. No. 14/867,809 Arnone, et al. filed Sep. 28, 2015.
U.S. Appl. No. 14/868,287 Arnone, et al. filed Sep. 28, 2015.
U.S. Appl. No. 14/868,364 Arnone, et al. filed Sep. 28, 2015.
U.S. Appl. No. 14/869,809 Arnone, et al. filed Sep. 29, 2015.
U.S. Appl. No. 14/869,819 Arnone, et al. filed Sep. 29, 2015.
U.S. Appl. No. 14/885,894 Arnone, et al. filed Oct. 16, 2015.
U.S. Appl. No. 14/919,665 Arnone, et al. filed Oct. 21, 2015.
U.S. Appl. No. 14/942,844 Arnone, et al. filed Nov. 16, 2015.
U.S. Appl. No. 14/942,883 Arnone, et al. filed Nov. 16, 2015.
U.S. Appl. No. 14/949,759 Arnone, et al. filed Nov. 23, 2015.
U.S. Appl. No. 14/952,758 Arnone, et al. filed Nov. 25, 2015.
U.S. Appl. No. 14/952,769 Arnone, et al. filed Nov. 25, 2015.
U.S. Appl. No. 14/954,922 Arnone, et al. filed Nov. 30, 2015.
U.S. Appl. No. 14/954,931 Arnone, et al. filed Nov. 30, 2015.
U.S. Appl. No. 14/955,000 Arnone, et al. filed Nov. 30, 2015.
U.S. Appl. No. 14/956,301 Arnone, et al. filed Dec. 1, 2015.
U.S. Appl. No. 14/965,231 Arnone, et al. filed Dec. 10, 2015.
U.S. Appl. No. 14/965,846 Arnone, et al. filed Dec. 10, 2015.
U.S. Appl. No. 14/981,640 Arnone, et al. filed Dec. 28, 2015.
U.S. Appl. No. 14/981,775 Arnone, et al. filed Dec. 28, 2015.
U.S. Appl. No. 14/984,943 Arnone, et al. filed Dec. 30, 2015.
U.S. Appl. No. 14/984,965 Arnone, et al. filed Dec. 30, 2015.
U.S. Appl. No. 14/984,978 Arnone, et al. filed Dec. 30, 2015.
U.S. Appl. No. 14/985,107 Arnone, et al. filed Dec. 30, 2015.
U.S. Appl. No. 14/995,151 Arnone, et al. filed Jan. 13, 2016.
U.S. Appl. No. 14/974,432 Arnone, et al. filed Dec. 18, 2015.
U.S. Appl. No. 14/997,413 Arnone, et al. filed Jan. 15, 2016.
U.S. Appl. No. 15/002,233 Arnone, et al. filed Jan. 20, 2016.
U.S. Appl. No. 15/005,944 Arnone, et al. filed Jan. 25, 2016.
U.S. Appl. No. 15/011,322 Arnone, et al. filed Jan. 29, 2016.
U.S. Appl. No. 15/051,535 Arnone, et al. filed Feb. 23, 2016.
U.S. Appl. No. 15/053,236 Arnone, et al. filed Feb. 25, 2016.
U.S. Appl. No. 15/057,095 Arnone, et al. filed Feb. 29, 2016.
U.S. Appl. No. 15/060,502 Arnone, et al. filed Mar. 3, 2016.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.

(56) References Cited

OTHER PUBLICATIONS

U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 15/362,660 Arnone, et al. filed Nov. 28, 2016.
U.S. Appl. No. 15/365,628 Arnone, et al. filed Nov. 30, 2016.
U.S. Appl. No. 15/367,541 Arnone, et al. filed Dec. 2, 2016.
U.S. Appl. No. 15/369,394 Arnone, et al. filed Dec. 5, 2016.
U.S. Appl. No. 15/370,425 Arnone, et al. filed Dec. 6, 2016.
U.S. Appl. No. 15/375,711 Arnone, et al. filed Dec. 12, 2016.
U.S. Appl. No. 15/387,117 Arnone, et al. filed Dec. 21, 2016.
U.S. Appl. No. 15/392,887 Arnone, et al. filed Dec. 28, 2016.
U.S. Appl. No. 15/393,212 Arnone, et al. filed Dec. 28, 2016.
U.S. Appl. No. 15/394,257 Arnone, et al. filed Dec. 29, 2016.
U.S. Appl. No. 15/396,352 Arnone, et al. filed Dec. 30, 2016.
U.S. Appl. No. 15/396,354 Arnone, et al. filed Dec. 30, 2016.
U.S. Appl. No. 15/396,365 Arnone, et al. filed Dec. 30, 2016.
U.S. Appl. No. 15/406,474 Arnone, et al. filed Jan. 13, 2017.
U.S. Appl. No. 15/413,322 Arnone, et al. filed Jan. 23, 2017.
U.S. Appl. No. 15/415,833 Arnone, et al. filed Jan. 25, 2017.
U.S. Appl. No. 15/417,030 Arnone, et al. filed Jan. 26, 2017.
U.S. Appl. No. 15/422,453 Arnone, et al. filed Feb. 1, 2017.
U.S. Appl. No. 15/431,631 Arnone, et al. filed Feb. 13, 2017.
U.S. Appl. No. 15/434,843 Arnone, et al. filed Feb. 16, 2017.
U.S. Appl. No. 15/439,499 Arnone, et al. filed Feb. 22, 2017.
U.S. Appl. No. 15/449,249 Arnone, et al. filed Mar. 3, 2017.
U.S. Appl. No. 15/449,256 Arnone, et al. filed Mar. 3, 2017.
U.S. Appl. No. 15/450,287 Arnone, et al. filed Mar. 6, 2017.
U.S. Appl. No. 15/457,827 Arnone, et al. filed Mar. 13, 2017.
U.S. Appl. No. 15/458,490 Arnone, et al. filed Mar. 14, 2017.
U.S. Appl. No. 15/460,195 Arnone, et al. filed Mar. 15, 2017.
U.S. Appl. No. 15/063,365 Arnone, et al. filed Mar. 7, 2016.
U.S. Appl. No. 15/063,496 Arnone, et al. filed Mar. 7, 2016.
U.S. Appl. No. 15/073,602 Arnone, et al. filed Mar. 17, 2016.
U.S. Appl. No. 15/074,999 Arnone, et al. filed Mar. 18, 2016.
U.S. Appl. No. 15/077,574 Arnone, et al. filed Mar. 22, 2016.
U.S. Appl. No. 15/083,284 Arnone, et al. filed Mar. 28, 2016.
U.S. Appl. No. 15/091,395 Arnone, et al. filed Apr. 5, 2016.
U.S. Appl. No. 15/093,685 Arnone, et al. filed Apr. 7, 2016.
U.S. Appl. No. 15/098,287 Arnone, et al. filed Apr. 13, 2016.
U.S. Appl. No. 15/098,313 Arnone, et al. filed Apr. 13, 2016.
U.S. Appl. No. 15/130,101 Arnone, et al. filed Apr. 15, 2016.
U.S. Appl. No. 15/133,624 Arnone, et al. filed Apr. 20, 2016.
U.S. Appl. No. 15/134,852 Arnone, et al. filed Apr. 21, 2016.
U.S. Appl. No. 15/139,148 Arnone, et al. filed Apr. 26, 2016.
U.S. Appl. No. 15/141,784 Arnone, et al. filed Apr. 29, 2016.
U.S. Appl. No. 15/155,107 Arnone, et al. filed May 16, 2016.
U.S. Appl. No. 15/156,222 Arnone, et al. filed May 16, 2016.
U.S. Appl. No. 15/158,530 Arnone, et al. filed May 18, 2016.
U.S. Appl. No. 15/161,174 Arnone, et al. filed May 20, 2016.
U.S. Appl. No. 15/170,773 Arnone, et al. filed Jun. 1, 2016.
U.S. Appl. No. 15/174,995 Arnone, et al. filed Jun. 6, 2016.
U.S. Appl. No. 15/179,940 Arnone, et al. filed Jun. 10, 2016.
U.S. Appl. No. 15/189,797 Arnone, et al. filed Jun. 22, 2016.
U.S. Appl. No. 15/190,745 Arnone, et al. filed Jun. 23, 2016.
U.S. Appl. No. 15/191,050 Arnone, et al. filed Jun. 23, 2016.
U.S. Appl. No. 15/219,257 Arnone, et al. filed Jul. 25, 2016.
U.S. Appl. No. 15/227,881 Arnone, et al. filed Aug. 3, 2016.
U.S. Appl. No. 15/241,683 Arnone, et al. filed Aug. 19, 2016.
U.S. Appl. No. 15/245,040 Arnone, et al. filed Aug. 23, 2016.
U.S. Appl. No. 15/233,294 Arnone, et al. filed Aug. 24, 2016.
U.S. Appl. No. 15/252,190 Arnone, et al. filed Aug. 30, 2016.
U.S. Appl. No. 15/255,789 Arnone, et al. filed Sep. 2, 2016.
U.S. Appl. No. 15/261,858 Arnone, et al. filed Sep. 9, 2016.
U.S. Appl. No. 15/264,521 Arnone, et al. filed Sep. 13, 2016.
U.S. Appl. No. 15/264,557 Arnone, et al. filed Sep. 13, 2016.
U.S. Appl. No. 15/271,214 Arnone, et al. filed Sep. 20, 2016.
U.S. Appl. No. 15/272,318 Arnone, et al. filed Sep. 21, 2016.
U.S. Appl. No. 15/273,260 Arnone, et al. filed Sep. 22, 2016.
U.S. Appl. No. 15/276,469 Arnone, et al. filed Sep. 26, 2016.
U.S. Appl. No. 15/280,255 Arnone, et al. filed Sep. 29, 2016.
U.S. Appl. No. 15/286,922 Arnone, et al. filed Oct. 6, 2016.
U.S. Appl. No. 15/287,129 Arnone, et al. filed Oct. 6, 2016.
U.S. Appl. No. 15/289,648 Arnone, et al. filed Oct. 10, 2016.
U.S. Appl. No. 15/297,019 Arnone, et al. filed Oct. 18, 2016.
U.S. Appl. No. 15/298,533 Arnone, et al. filed Oct. 20, 2016.
U.S. Appl. No. 15/336,696 Arnone, et al. filed Oct. 27, 2016.
U.S. Appl. No. 15/339,898 Arnone, et al. filed Oct. 31, 2016.
U.S. Appl. No. 15/345,451 Arnone, et al. filed Nov. 7, 2016.
U.S. Appl. No. 14/799,481 Arnone, et al. filed Jul. 14, 2015.
U.S. Appl. No. 15/362,214 Arnone, et al. filed Nov. 28, 2016.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.

(56) References Cited

OTHER PUBLICATIONS

U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.
U.S. Appl. No. 14/708,160 Arnone, et al. filed May 8, 2015.
U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.
U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.
U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.
U.S. Appl. No. 14/730,183 Arnone, et al. filed Jun. 3, 2015.
U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.
U.S. Appl. No. 14/205,303 Arnone, et al., filed Mar. 11, 2014.
U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.

* cited by examiner

Table 1:

Example Reward Prize Allocation Rules:

If Individual_Skill_Metric > Average_Skill_Metric(Game_Type) then Skill_Reward = Accumulated_Unacheived_Skill_Objective_Credits(Game_Type) X 0.5
(in other words, if an individual player's performance is greater than the average skill performance for all players playing the same game, then that individual player will be given the opportunity to win through skillful play, one half of all credits in the skill Reward pool contributed for that game)

If (Individual_Skill_Metric > Average_Skill_Metric(Game_Type)) AND (RTP(Game_Type) < Target_RTP(Game_Type) then Skill_Reward= Accumulated_Unacheived_Skill_Objective_Credits(Game_Type) X 0.75
(in other words, if an individual player's performance is greater than the average skill performance for all players playing the same game AND the return to players of that game is less than a target return to players for that game, then that individual player will be given the opportunity to win through skillful play, three quarters of all credits in the skill Reward pool contributed for that game)

*FIG. 11*

VARIABLE SKILL REWARD WAGERING SYSTEM

CROSS REFERENCE TO RELATED APPLICATIONS

This application claims the benefit of U.S. Provisional Application No. 62/313,685, filed Mar. 25, 2016, U.S. Provisional Application No. 62/320,397, filed Apr. 8, 2016, U.S. Provisional Application No. 62/329,163, filed Apr. 28, 2016, U.S. Provisional Application No. 62/338,332, filed May 18, 2016, the contents of each of which are incorporated by reference herein in their entirety.

FIELD OF THE INVENTION

Embodiments of the invention are generally related to communications within data processing systems. More particularly, the invention relates to the communication and processing of wagering data.

BACKGROUND

The gaming industry has traditionally developed electronic gaming machines (EGMs) that implement simple wagers. However, more complicated wagering processes need communication and processing systems that are better suited for implementing these more complicated wagering processes. Various aspects of embodiments of the invention meet such a need.

SUMMARY OF THE INVENTION

Systems and methods in accordance with embodiments of the invention provide a communication and data processing system constructed for a variable skill reward wagering system.

In an embodiment of the invention, a process controller operates as an interface between an interactive controller that determines skill outcomes and a wagering subcontroller that determines chance-based wager outcomes. By virtue of this feature, the wagering subcontroller is isolated from the interactive controller allowing the interactive controller to operate in an unregulated environment while allowing the wagering subcontroller to operate in a regulated environment, thus providing for more efficient management of the operations of such a system.

In another embodiment of the invention, a single wagering subcontroller may provide services to two or more interactive controllers, thus allowing a variable skill reward wagering system to operate more efficiently over a large range of scaling.

In another embodiment of the invention, multiple types of interactive controllers using different operating systems may be interfaced to a single type of process controller without requiring customization of the process controller and/or the wagering subcontroller, thus improving the efficiency of the process controller and/or the wagering subcontroller by reducing complexity associated with maintaining separate process controllers and/or wagering subcontrollers for each type of interactive controller.

In another embodiment of the invention, an interactive controller may be provided as a user device under control of a user while maintaining the process controller in an environment under the control of a regulated operator of wagering equipment, thus providing for a more economical system as the regulated operator need not expend capital to purchase interactive controllers.

In another embodiment of the invention, data communicated between the controllers may be encrypted to increase security of the variable skill reward wagering system.

In another embodiment of the invention, a process controller isolates chance-based wager proposition logic and skill proposition logic as unregulated logic from a regulated wagering subcontroller, thus allowing errors in the skill proposition logic and/or chance-based wager proposition logic to be corrected, new skill proposition logic and/or chance-based wager proposition logic to be used, or modifications to be made to the skill proposition logic and/or chance-based wager proposition logic without a need for time-consuming regulatory approval.

In another embodiment of the invention, an interactive application may require extensive processing resources from an interactive controller leaving few processing resources for the functions performed by a process controller and/or a wagering subcontroller. By virtue of an architecture of some embodiments of the invention, processing loads may be distributed across multiple devices such that operations of the interactive controller may be dedicated to an interactive application and the processes of the process controller and/or wagering subcontroller are not burdened by the requirements of the interactive application.

In another embodiment of the invention, a variable skill reward wagering system operates with its components being distributed across multiple devices. These devices can be connected by communication channels including, but not limited to, local area networks, wide area networks, local communication buses, and/or the like. The devices may communicate using various types of protocols, including but not limited to, networking protocols, device-to-device communications protocols, and the like. In many such embodiments, one or more components of a variable skill reward wagering system are distributed in close proximity to each other and communicate using a local area network and/or a communication bus. In several embodiments, an interactive controller and a process controller of a variable skill reward wagering system are in a common location. In some embodiments, a process controller communicates with an external interactive controller. In various embodiments, these multiple controllers and sub-controllers can be constructed from or configured using a single device or a plurality of devices such that a variable skill reward wagering system is executed as a system in a virtualized space such as, but not limited to, where a wagering subcontroller and a process controller are large scale centralized servers and are operatively connected to distributed interactive controllers via a wide area network such as the Internet or a local area network. In such embodiments, the components of a variable skill reward wagering system may communicate using a networking protocol or other type of device-to-device communications protocol.

In another embodiment of the invention, an interactive controller is an interactive server acting as a host for managing head-to-head user interactions over a network of interactive sub-controllers connected to the interactive server using a communication link. The interactive server provides an environment where users can compete directly with one another and interact with other users.

In an embodiment, a variable skill reward wagering system includes an interactive controller, wherein the interactive controller is configured to determine a skill outcome for a user while playing a skill-based game of the interactive controller; and communicate the skill outcome to a process controller. The system further includes a variable skill reward controller, wherein the variable skill reward controller is configured to determine an amount of credits to add to a variable skill reward pool credit meter datastore, receive the skill outcome for the user from the process controller, determine a variable skill reward of credits from the variable skill reward pool credit meter datastore for the user based on the skill outcome. The process controller is configured to communicate with the interactive controller and the variable skill reward controller, and to receive the skill outcome from the interactive controller, communicate the skill outcome to the variable skill reward controller, and receive the variable skill reward of credits from the variable skill reward controller.

In some embodiments, the interactive controller and the process controller are configured from the same device.

In various embodiments, the variable skill reward wagering system of claim 1, wherein the process controller and the variable skill reward controller are configured from the same device.

In many embodiments, a variable skill reward wagering system includes an enclosure constructed to mount a user input device operatively connected to the interactive controller, a user output device operatively connected to the interactive controller, a credit input device operatively connected to the process controller, and a credit output device operatively connected to the process controller.

In various embodiments, a variable skill reward wagering system includes a random number generator, and the process controller is further configured to determine a skill proposition of the skill-based game based on a random outcome generated by the random number generator, communicate the skill proposition to the interactive controller, and communicate with a credit output device to generate a credit output based on the variable skill reward of credits. The interactive controller is further configured to receive the skill proposition from the process controller, generate a user presentation based on the skill proposition, detect user interactions with the user presentation, determine the skill outcome based on the user interactions and the skill proposition, and communicate the skill outcome to the process controller.

In some embodiments, a variable skill reward wagering system includes one or more processors and a memory connected to the one or more processors, the memory storing processor executable instructions that when executed by the one or more processors, cause the one or more processors to determine an amount of credits to add to a variable skill reward pool credit meter datastore, determine a skill outcome for a user while playing a skill-based game, determine a variable skill reward of credits from the variable skill reward pool credit meter datastore for the user based on the skill outcome, and communicate with a credit output device to generate a credit output based on the variable skill reward of credits.

In various embodiments, a variable skill reward wagering system includes a random number generator, and processor executable instructions further cause one or more processors to determine a skill proposition of a skill-based game based on a random outcome generated by the random number generator, generate a user presentation based on the skill proposition, detect user interactions with the user presentation, and determine a skill outcome based on the user interactions and the skill proposition.

BRIEF DESCRIPTION OF THE DRAWINGS

FIG. 11 is a table including rules for a variable skill reward wagering system in accordance with an embodiment of the invention.

DETAILED DESCRIPTION

Figure 1:
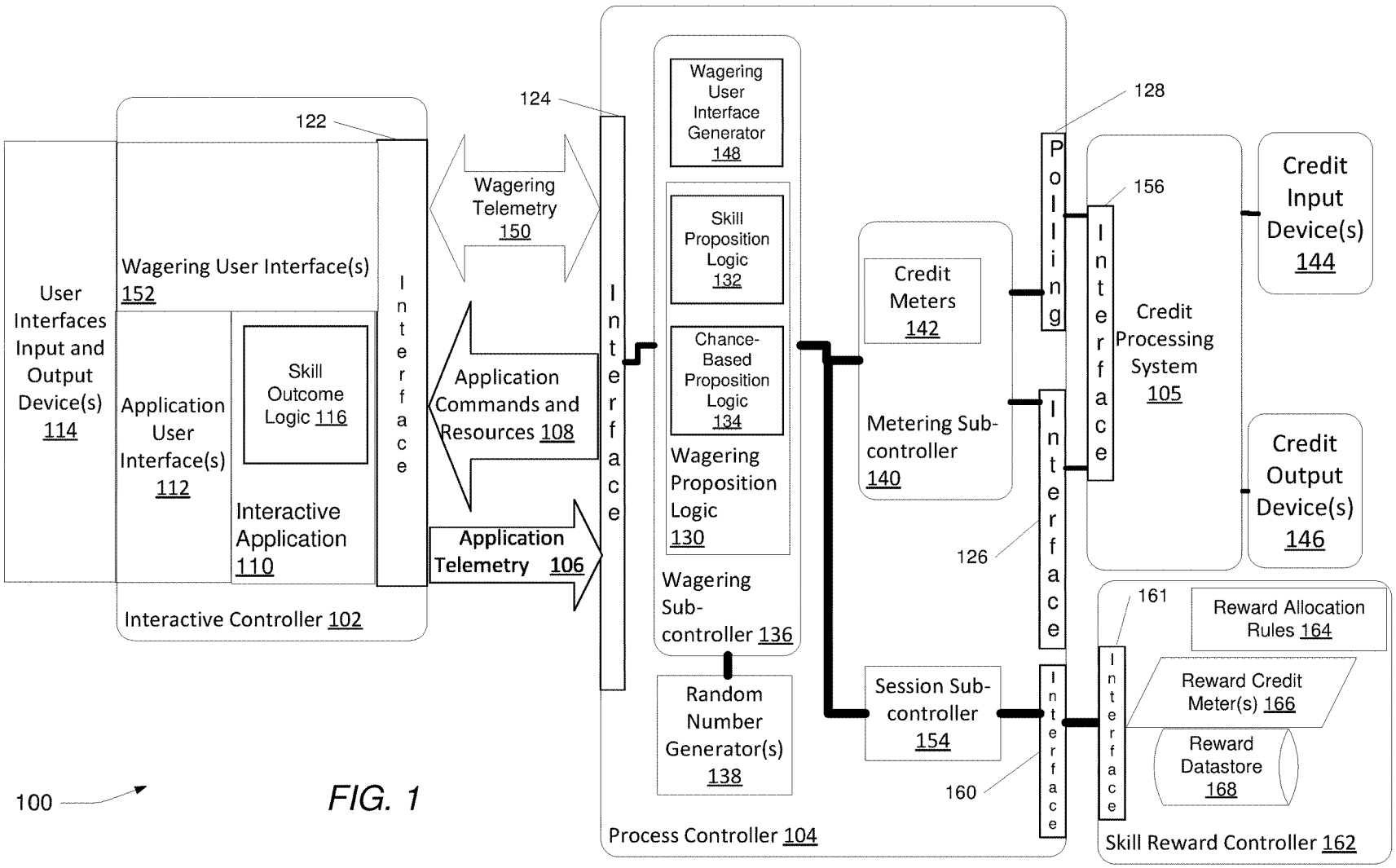
FIG. 1 is a diagram of a structure of a variable skill reward wagering system in accordance with various embodiments of the invention.

A variable skill reward wagering system allows for the management of a combined wagering proposition having a skill proposition for one or more users where the skill proposition is associated with one or more chance-based wager outcomes generated in accordance with a chance-based wager proposition. In some embodiments of a variable skill reward wagering system, an interactive application executed by an interactive controller provides skill proposition components of the variable skill reward wagering system. The interactive controller is operatively connected to a process controller that manages and configures the interactive controller and the interactive application, and determines skill propositions associated with chance-based wager outcomes determined by a wagering subcontroller that are resolved as skill outcomes determined by the interactive application.

In some embodiments, the interactive controller also provides a wagering user interface that is used to receive commands and display data for a wagering process and wagering outcome determined from the skill outcome in accordance with a combined wagering proposition. The content of the wagering user interface is controlled by the process controller and includes content provided by the wagering subcontroller and the interactive controller.

In various embodiments, an interactive controller provides a management user interface used to manage a user profile.

Many different types of interactive applications may be utilized with the variable skill reward wagering system. In some embodiments, the interactive application reacts to the physical activity of a user. In these embodiments, the interactive application senses user interactions with the interactive application through one or more sensors that monitor the user's physical activities. Such sensors may include, but are not limited to, physiological sensors that monitor the physiology of the user, environmental sensors that monitor the physical environment of the interactive controller, accelerometers that monitor changes in motion of the interactive controller, and location sensors that monitor the location of the interactive controller such as global positioning sensors.

In some embodiments, the interactive application implements a skill-based game and interacts with the user by sensing skillful interactions with an interactive user interface generated by the interactive application.

In many embodiments, the interactive application generates various types of interactive elements in an interactive application environment. In some embodiments, these interactive elements are interactive application resources utilized within the interactive application environment to provide an interactive experience for a user.

In accordance with some embodiments, a chance-based wager outcome associated with the skill proposition can influence interactive elements in the interactive application environment such as, but not limited to, automatically providing one or more new interactive elements, automatically restoring one or more consumed interactive elements, automatically causing the loss of one or more interactive elements, and automatic restoration or placement of one or more fixed interactive elements.

In various embodiments, the wagers may be made using one or more credits.

In some embodiments, credits can be one or more credits that are purchased using, and redeemed in, a real world currency having a real world value.

In many embodiments, credits can be one or more credits in a virtual currency. Virtual currency is an alternate currency that can be acquired, purchased or transferred by or to a user, but does not necessarily directly correlate to a real world currency. In many such embodiments, credits in a virtual currency are allowed to be purchased using a real world currency but are prevented from being redeemed in a real world currency having a real world value.

In several embodiments, interaction with the interactive elements of the interactive application, application credits can be optionally consumed and/or accrued within the interactive application as a result of interaction with the interactive elements. Application credits can be in the form of, but not limited to, application environment credits, experience points, and points generally.

In various embodiments, application credits are awarded on the basis of skillful interactions with the interactive elements of a skill-based interactive application. The skill-based interactive application can have one or more skill metrics, embedded within a process controller and/or an interactive controller that provides the skill-based interactive application, that can be used to determine user performance against one or more skill objectives of the skill-based interactive application in accordance with a skill proposition.

In many embodiments, application credits can be used to purchase in-application items, including but not limited to, application interactive elements that have particular properties, power ups for existing items, and other item enhancements.

In some embodiments, application credits may be used to earn entrance into a sweepstakes drawing, to earn entrance in a tournament with prizes, to score in the tournament, and/or to participate and/or score in any other game event.

In several embodiments, application credits can be stored on a user-tracking card, voucher or in a network-based user tracking system where the application credits are attributed to a specific user.

In many embodiments, a combined wagering proposition includes a wager of application credits for payout of application credits, interactive application elements, and/or interactive application objects in accordance with the chance-based wager proposition.

In a number of embodiments, a wager of an amount of credits results in a payout of application credits, interactive elements, and/or interactive application objects that have a credit value if cashed out.

In some embodiments, interactive application objects include in-application objects that may be utilized to enhance user interactions with the interactive application. Such objects include, but are not limited to, power-ups, enhanced in-application items, and the like. In some embodiments, the interactive application objects include objects that are detrimental to user interactions with the interactive application such as, but not limited to, obstructions in the interactive application space, a temporary handicap, an enhanced opponent, and the like.

In numerous embodiments, an interactive application command is an instruction by a process controller to an interactive controller and/or an interactive application of the interactive controller to modify a state of an interactive application or modify one or more interactive application resources or interactive elements. In some embodiments, the interactive application commands may be automatically generated by the process controller using one or more of a chance-based wager outcome and/or application environment variables. An interactive application command can be used by a process controller control many processes of an interactive application, such as, but not limited to, an causing an addition of a period of time available for a current interactive application session for the interactive application, an addition of a period of time available for a future variable skill reward wagering system interactive application session or any other modification to the interactive application interactive elements that can be utilized during an interactive application session.

In some embodiments, asynchronous communications provided for by a variable skill reward wagering system may reduce an amount of idle waiting time by an interactive controller of the variable skill reward wagering system, thus increasing an amount of processing resources that the interactive controller may provide to an interactive application or other processes of the interactive controller. In many embodiments, asynchronous communications provided for by a variable skill reward wagering system reduces an amount of idle waiting time by a process controller, thus increasing an amount of processing resources that the process controller may provide to determine chance-based wager outcomes, and other processes provided by the process controller.

In some embodiments, a wagering subcontroller of a variable skill reward wagering system may be operatively connected to a plurality of interactive controllers through a process controller and the asynchronous communications provided for by the process controllers allows the wagering subcontroller to operate more efficiently by providing one or more chance-based wager outcomes to a larger number of interactive controllers than would be achievable without the process controller of the variable skill reward wagering system.

In some embodiments, a variable skill reward wagering system including a process controller operatively connected to a wagering subcontroller and operatively connected to an interactive controller wherein the process controller provides for simplified communication protocols for communications of the interactive controller as the interactive controller may communicate interactions with an interactive application provided by the interactive controller to the process controller without regard to a nature of a chance-based wager proposition.

In various embodiments, a variable skill reward wagering system including a process controller operatively connected to a wagering subcontroller and operatively connected to an interactive controller may provide for simplified communication protocols for communications of the wagering subcontroller as the wagering subcontroller may receive skill proposition requests and communicate determined skill propositions associated with chance-based wager outcomes without regard to a nature of an interactive application provided by the interactive controller.

In some embodiments, a variable skill reward wagering system including a process controller operatively connecting a wagering subcontroller to an interactive controller may provide for reduced processing requirement for the interactive controller by offloading the execution of a random number generator from the interactive controller to the process controller. In various such embodiments, additional processing resources may be made available to graphics processing or other processing intensive operations by the interactive controller because of the offloaded random number processing.

In various embodiments, a variable skill reward wagering system including a process controller operatively connecting a wagering subcontroller to an interactive controller provides for operation of the interactive controller in an unsecure location or manner, while providing for operation of the wagering subcontroller in a secure location or manner.

In some embodiments, a variable skill reward wagering system including a process controller operatively connecting a wagering subcontroller to an interactive controller allows the variable skill reward wagering system to have regulated components coupled to unregulated components in a heterogeneous regulated environment. For example, in several such embodiments, the interactive controller may be a device that is not regulated by a wagering regulatory agency whereas the wagering subcontroller is regulated by the wagering regulatory agency. A process controller of a variable skill reward wagering system may provide for isolation of the processing of the interactive controller from the processing of the wagering subcontroller. In such a heterogeneous regulatory environment, the process controller may or may not be itself a regulated by the wagering regulatory authority. In addition, components of an interactive application executed by the interactive controller may be either regulated or unregulated by the wagering regulatory agency.

FIG. 1 is a diagram of a structure of a variable skill reward wagering system in accordance with various embodiments of the invention. The variable skill reward wagering system 100 includes an interactive controller 102, a process controller 104, and a credit processing system 105. The interactive controller 102 is operatively connected to, and communicates with, the process controller 104. The process controller 104 is also operatively connected to, and communicates with, the credit processing system 105.

In various embodiments, the interactive controller 102 executes an interactive application 110 and provides one or more user interface input and output devices 114 so that one or more users can interact with the interactive application 110. In various embodiments, user interface input devices include, but are not limited to: buttons or keys; keyboards; keypads; game controllers; joysticks; computer mice; track balls; track buttons; touch pads; touch screens; accelerometers; motion sensors; video input devices; microphones; and the like. In various embodiments, user interface output devices include, but are not limited to: audio output devices such as speakers, headphones, earbuds, and the like; visual output devices such as lights, video displays and the like; and tactile devices such as rumble pads, hepatic touch screens, buttons, keys and the like. The interactive controller 102 provides for user interactions with the interactive application 110 by executing the interactive application 110 that generates an application user interface 112 that utilizes the user interface input devices to detect user interactions with the interactive controller 102 and generates an interactive user interface that is presented to the user utilizing the user interface output devices.

In some embodiments, one or more components an interactive controller are housed in an enclosure such as a housing, cabinet, casing or the like. The enclosure further includes one or more user accessible openings or surfaces that constructed to mount the user interface input devices and/or the user interface output devices.

The interactive controller 102 is operatively connected to, and communicates with, the process controller 104. The interactive controller 102 receives application command and resource data 108 including skill proposition data, application command data, and resource data, from the process controller 104. Via the communication of the application command and resource data 108, the process controller 104 can control the operation of the interactive controller 102 by communicating control parameters to the interactive application 110 during the interactive application's execution by the interactive controller 102.

In some embodiments, during execution of the interactive application 110 by the interactive controller 102, the interactive controller 102 communicates, as application telemetry data 106, user interactions with one or more interactive elements of the application user interfaces 112 of the interactive application to the process controller 104. the application telemetry data 106 may include, but is not limited to, application environment variables that indicate the state of the interactive application 110, interactive controller data indicating a state of the interactive controller 102, user actions and interactions between one or more users and the interactive application 110 provided by the interactive controller 102, and utilization of interactive elements in the interactive application 110 by one or more users.

In some embodiments, the application telemetry 106 includes a skill outcome as determined by the interactive application 110 using skill outcome logic 116, the application command and resource data 108, and user interactions with one or more application user interfaces 112 of the interactive application.

In some embodiments, the interactive application 110 is a skill-based interactive application. In such embodiments, execution of the skill-based interactive application 110 by the interactive controller 102 is based on one or more users' skillful interaction with the interactive application 110, such as, but not limited to, the users' utilization of the interactive elements of the interactive application during the users' skillful interaction with the skill-based interactive application. In such an embodiment, the process controller 104 communicates with the interactive controller 102 in order to allow the coupling of the skill-based interactive application to chance-based wager outcomes determined in accordance with a chance-based wager proposition of the wagering subcontroller 136.

In some embodiments, the interactive application 110 uses skill proposition data, interactive application command data, and/or resource data included in the application commands and resources 108 to generate a skill proposition presented to one or more users as one or more application user interfaces 112 using one or more output devices of user interface and output device(s) 114. The one or more users skillfully interact with the one or more application user interfaces 112 using one or more of input devices of the user interface input and output devices 114. The interactive application 110 determines a skill outcome based on the skillful interactions of the one or more users and communicates data of the determined skill outcome to the process controller 104 as part of the application telemetry 106. In some embodiments, the interactive application 110 also communicates as part of the application telemetry data 106, data encoding the one or more users' interactions with the interactive application 110.

In some embodiments, the skill outcome logic 116 and the skill proposition data included in the application commands and resources 108 are for a skill proposition for one or more users. The interactive application 110 determines skill outcomes based on the skill proposition and the one or more users' skillful interactions with the interactive application. The skill outcomes are communicated by the interactive controller 102 to the process controller 104 included in the application telemetry 106.

In some embodiments, the interactive controller 102 includes one or more sensors that sense various aspects of the physical environment of the interactive controller 102. Examples of sensors include, but are not limited to: global positioning sensors (GPSs) for sensing communications from a GPS system to determine a position or location of the interactive controller; temperature sensors; accelerometers; pressure sensors; and the like. Sensor telemetry data is communicated by the interactive controller to the process controller 104 as part of the application telemetry data 106. The process controller 104 receives the sensor telemetry data and uses the sensor telemetry data to make wagering decisions.

In many embodiments, the interactive controller 102 includes one or more wagering user interfaces 118 used to display wagering data, via one or more of the user interface input and output devices 114, to one or more users.

In various embodiments, an application control interface 122 resident in the interactive controller 102 provides an interface between the interactive controller 102 and the process controller 104.

In some embodiments, the application control interface 122 implements an interactive controller to process controller communication protocol employing an interprocess communication protocol so that the interactive controller and the process controller may be implemented on the same device. In operation, the application control interface 122 provides application programming interfaces that are used by the interactive application 110 of the interactive controller 102 to communicate outgoing data and receive incoming data by passing parameter data to another process or application.

In some embodiments, the application control interface 122 implements an interactive controller to process controller communication protocol employing an interdevice communication protocol so that the interactive controller and the process controller may be implemented on different devices. The interdevice protocol may utilize a wired communication bus or wireless connection as a physical layer.

In various embodiments, the application control interface 122 implements an interactive controller to process controller communication protocol employing a networking protocol so that the interactive controller and the process controller may be implemented on different devices connected by a network. The networking protocol may utilize a wired communication bus or wireless connection as a physical layer. In many such embodiments, the network includes a cellular telephone network or the like and the interactive controller is a mobile device such as a smartphone or other device capable of using the telephone network. During operation, the application control interface 122 communicates outgoing data to an external device by encoding the data into a signal and transmitting the signal to an external device. The application control interface receives incoming data from an external device by receiving a signal transmitted by the external device and decoding the signal to obtain the incoming data.

The process controller 104 provides an interface between a skill proposition resolved for one or more users when skillfully interacting with the interactive application 110 provided by the interactive controller 102, and one or more chance-based wager outcomes, provided in-part by a wagering subcontroller 136.

In various embodiments, the process controller 104 includes a wagering subcontroller 136 having a rule-based decision engine that receives application telemetry data 106 from the interactive controller 102. The rule-based decision engine has combined wagering proposition logic 130 including skill proposition logic 132 and chance-based wager proposition logic 134. The decision engine uses the application telemetry data 106, along with chance-based wager proposition logic 134, and a random outcome generated by one or more random number generators (RNGs) 138 to generate one or more chance-based wager outcomes of a combined wagering proposition.

In some embodiments, the chance-based wager proposition logic 134 includes one or more paytables that may be used to determine a chance-based wager outcome based on one or more random outcomes from one or more random number generators. A wagering subcontroller uses the one or more paytables to map the one or more random outcomes to a chance-based wager outcome. The one or more paytables are used to implement one or more chance-based wager propositions in conjunction with one or more random outcomes of the one or more random number generators.

In an embodiment, the application telemetry data 106 used by the decision engine encodes data about the operation of the interactive application 110 executed by the interactive controller 102.

In some embodiments, the application telemetry data 106 encodes interactions of a user, such as a user's interaction with an interactive element of the interactive application 110.

In many embodiments, the application telemetry data 106 includes a state of the interactive application 110, such as values of variables that change as the interactive application 110 executes.

In several embodiments, the decision engine includes one or more rules as part of the chance-based wager proposition logic 134 used by the decision engine 122 to determine how a chance-based wager outcome should generated. Each rule includes one or more variable values constituting a pattern that is to be matched by the wagering subcontroller 136 using the decision engine to one or more variable values encoded in the application telemetry data 106. Each rule also includes one or more actions that are to be taken if the pattern is matched. Actions can include automatically generating the chance-based wager outcome in accordance with the chance-based wager proposition logic 134 and a random outcome generated by one or more random number generators 138. During operation, the decision engine receives application telemetry data 106 from the interactive controller 102 via interface 160. The decision engine performs a matching process of matching the variable values encoded in the application telemetry data 106 to one or more variable patterns of one or more rules. If a match between the variable values and a pattern of a rule is determined, then the wagering controller 104 performs the action of the matched rule.

In some embodiments, the wagering subcontroller 136 uses the chance-based wager outcome in conjunction with the application telemetry data 106 and skill proposition logic 132, to automatically generate application command and resource data 108 including skill proposition data of a combined wagering proposition that the process controller 104 communicates to the interactive controller 102 via interfaces 124 and 122.

In some embodiments, the decision engine includes one or more rules as part of skill proposition logic 132 used by the decision engine to automatically generate the application command and resource data 108 that is then communicated to the interactive controller 102. Each rule includes one or more variable values constituting a pattern that is to be matched to one or more variable values encoded in the application telemetry data 106 and the chance-based wager outcome. Each rule also includes one or more actions that are to be automatically taken by the wagering subcontroller 136 if the pattern is matched. Actions can include automatically generating skill proposition data, interactive application command data, and/or resource data 108 and using the skill proposition data, interactive application command data, and/or resource data 108 to control the interactive controller 102 to affect execution of the interactive application 110 as described herein. In operation, wagering subcontroller 104 uses the decision engine 122 to match the variable values encoded in the in the chance-based wager outcome data to one or more patterns of one or more rules of the skill proposition logic 132. If a match between the variable values and a pattern of a rule is found, then the process controller automatically performs the action of the matched rule. In some embodiments, the process controller 104 uses the application telemetry data 106 received from the interactive controller 102 in conjunction with the chance-based wager outcome to generate the skill proposition data, interactive application command data, and/or resource data 108.

The interactive controller receives the skill proposition data, interactive application command data, and resource data 108 and automatically uses the skill proposition data, interactive application command data, and/or resource data 108 to configure and command the processes of the interactive application 110.

In some embodiments, the interactive application 110 operates utilizing a scripting language. The interactive application 110 parses scripts written in the scripting language and executes commands encoded in the scripts and sets variable values as defined in the scripts. In operation of such embodiments, the process controller 104 automatically generates skill proposition data, interactive application command data, and/or resource data 108 in the form of scripts written in the scripting language that are communicated to the interactive controller 102 during execution of the interactive application 110. The interactive controller 102 receives the scripts and passes them to the interactive application 110. The interactive application 110 receives the scripts, parses the scripts and automatically executes the commands and sets the variable values as encoded in the scripts.

In many embodiments, the interactive application 110 automatically performs processes as instructed by commands communicated from the process controller 104. The commands command the interactive application 110 to perform specified operations such as executing specified commands and/or setting the values of variables utilized by the interactive application 110. In operation of such embodiments, the process controller 104 automatically generates commands that are encoded into the skill proposition data, interactive application command data, and/or resource data 108 that are communicated to the interactive controller 102. The interactive controller 102 passes the skill proposition data, interactive application command data, and/or resource data 108 to the interactive application 110. The interactive application parses the skill proposition data, interactive application command data, and/or resource data and automatically performs operations in accordance with the commands encoded in the skill proposition data, interactive application command data, and/or resource data 108.

In many embodiments, the process controller 104 includes a pseudo random or random outcome generator used to generate random outcomes that are used by the decision engine to generate portions of the skill proposition data, interactive application command data, and/or resource data 108.

In various embodiments, the process controller 104 includes one or more interfaces, 124, 126 and 128 that operatively connect the process controller 104 to one or more interactive controllers, such as interactive controller 102, and to one or more credit processing systems, such as credit processing system 105.

In some embodiments, one or more of the process controller interfaces implement a process controller to device or server communication protocol employing an interprocess communication protocol so that the process controller and one or more of an interactive controller, a wagering sub-controller, and/or a session sub-controller may be implemented on the same device. In operation, the process controller interfaces provide application programming interfaces or the like that are used by the process controller to communicate outgoing data and receive incoming data by passing parameter data to another process or application running on the same device.

In some embodiments, one or more of the process controller interfaces implement a process controller communication protocol employing an interdevice communication protocol so that the process controller may be implemented on a device separate from the one or more interactive controllers, the one or more session sub-controllers and/or the one or more wagering subcontrollers. The interdevice protocol may utilize a wired communication bus or wireless connection as a physical layer. In various embodiments, one or more of the process controller interfaces implement a process controller communication protocol employing a networking protocol so that the process controller may be operatively connected to the one or more interactive controllers, the one or more session sub-controllers, and/or the one or more wagering subcontrollers by a network. The networking protocol may utilize a wired communication bus or wireless connection as a physical layer. In many such embodiments, the network includes a cellular telephone network or the like and the one or more interactive controllers include a mobile device such as a smartphone or other device capable of using the telephone network. During operation, the one or more process controller interfaces communicate outgoing data to an external device or server by encoding the data into a signal and transmitting the signal to the external device or server. The one or more process controller interfaces receive incoming data from an external device or server by receiving a signal transmitted by the external device or server and decoding the signal to obtain the incoming data.

In several embodiments, the wagering subcontroller 136 is a controller for providing one or more chance-based wagers in accordance with one or more chance-based wager propositions provided by the variable skill reward wagering system 100. Types of value of a wager can be one or more of several different types. Types of value of a wager can include, but are not limited to, a wager of an amount of credits corresponding to a real currency or a virtual currency, a wager of an amount of application credits earned through interaction with an interactive application, a wager of an amount of interactive elements of an interactive application, and a wager of an amount of objects used in an interactive application.

In various embodiments, a skill outcome determined for a wager in accordance with a skill proposition can increase or decrease an amount of the type of value used in the wager, such as, but not limited to, increasing or decreasing an amount of credits for a wager of credits. In various embodiments, a skill outcome determined for a wager in accordance with a skill proposition can increase or decrease an amount of a type of value that is different than a type of value of the wager, such as, but not limited to, increasing an amount of an object of an interactive application for a wager of credits.

In many embodiments, the process controller 104 includes one or more random number generators (RNGs) 138 for generating random outcomes. The wagering sub-controller uses the one or more random outcomes along with the chance-based wager proposition logic 130 to generate a chance-based wager outcome in accordance with a chance-based of a combined wagering proposition.

In several embodiments, the process controller 104 includes a metering sub-controller 140 operatively connected to the credit processing system 105 via interfaces 126 and 128. The metering sub-controller 140 communicates with the credit processing system 105 to receive incoming credit data from the credit processing system 105. The metering sub-controller 140 uses the incoming credit data to transfer credits into the variable skill reward wagering system and onto one or more credit meter datastores 142. The metering sub-controller 140 communicates outgoing credit data to the credit processing system 105 to transfer credits off of the one or more credit meter datastores 142 and out of the variable skill reward wagering system.

In several embodiments, during operation, the metering sub-controller 140 communicates with the credit processing system 105 to receive incoming credit data from the credit processing system 105 and adds credits onto the one or more credit meter datastores 110 at least partially on the basis of the incoming credit data. The one or more random number generators 138 execute processes that generate random outcomes. The wagering subcontroller 136 uses the chance-based wager proposition logic 134 and the random outcomes to generate a chance-based wager outcome of a combined wagering proposition. The wagering subcontroller uses the chance-based wager outcome along with the skill proposition logic 132 to generate a skill proposition. The skill proposition is communicated by the process controller as part of the application command and resource data 108 to the interactive controller 102. The interactive application 110 uses the skill proposition data along with the skill outcome logic 116 to generate a presentation for the use including the one or more user interfaces 112. One or more users interact with the one or more application user interfaces 112 through the one or more user interface input and output devices 114. The interactive application 110 determines a skill outcome based on the interactions of the one or more users and communicates data of the skill outcome as part of the application telemetry data 106 to the process controller 104. The wagering sub controller 136 receives the skill outcome data and instructs the metering sub-controller 140 to add credits to, or deduct credits from, the one or more credit meter datastores 110 based in part on the skill outcome data. For example, in some embodiments, the metering sub-controller is instructed to add an amount of credits to a credit meter datastore of the one or more credit meter datastores 110 when the skill outcome indicates a win for a user associated with the credit meter datastore. In various embodiments, the metering sub-controller is instructed to deduct an amount of credits from the credit meter datastore when the skill outcome indicates a loss for the user. At an end of a wagering session, the metering sub-controller 140 transfers credits off of the one or more credit meter datastores 110 and out of the variable skill reward wagering system by communicating outgoing credit data to the credit processing system 105.

In many embodiments, the one or more random number generators 138 generate random numbers by continuously generating pseudo random numbers using a pseudo random number generator. A most current pseudo random number is stored in a buffer thus constantly refreshing the buffer. In some embodiments, the buffer is refreshed at a rate exceeding 100 times per second. When the wagering subcontroller 136 requests a random outcome, the wagering subcontroller 136 receives the stored most current pseudo random number from the buffer. As timing between requests for a random outcome is not deterministic, the resulting output from the buffer is a random outcome such as a random number.

In many embodiments, the random outcome is used along with a paytable that the wagering subcontroller selects from one or more paytables. The selected paytable includes a mapping of values in a range of values of the random outcome to specified multipliers to be applied to an amount of wagered credits to determine a chance-based wager outcome as an amount of credits to be added to one or more credit meter datastores associated with the chance-based wager proposition. A multiplier is selected from the paytable based on the random outcome and the selected multiplier is used along with an amount of credits wagered to determine a chance-based wager outcome as an amount of credits.

In some embodiments, a range of the value of a random outcome is mapped to one or more symbols representing one or more elements of a traditional chance-based wager proposition. In several such embodiments, a random outcome is mapped to a virtual card of a deck of virtual cards. In another such embodiment, the random outcome is mapped to a virtual face of a virtual die. In yet another such embodiment, the random outcome is mapped to symbol of a virtual reel strip on a virtual reel slot machine. In yet another such embodiment, the random outcome is mapped to a pocket of a virtual roulette wheel. In some embodiments, two or more random outcomes are mapped to appropriate symbols to represent a completed chance-based wager proposition. In one such embodiment, two or more random outcomes are mapped to faces of two or more virtual dice to simulate a random outcome generated by throwing two or more dice. In another such embodiment, multiple random outcomes are mapped to virtual cards from a virtual deck of cards without replacement. In yet another such embodiment, two or more random outcomes are mapped to two or more virtual reel strips to create stop positions for a virtual multi-reel slot machine.

In some embodiments, a wagering subcontroller determines a chance-based wager outcome by executing proposition determination commands included in chance-based wager proposition logic that define processes of a combined wagering proposition where the proposition determination commands are formatted in a scripting language. In operation, a decision engine of a process controller generates the proposition determination commands in the form of a script written in the scripting language. The script includes the proposition determination commands that describe how the wagering subcontroller is to generate a chance-based wager outcome. The wagering subcontroller parses the script encoded in the chance-based wager proposition determination command data and executes the commands included in the script to generate the chance-based outcome.

In some embodiments, a wagering subcontroller determines a chance-based wager outcome by executing proposition determination commands that define processes of the wagering user interface. In operation, a decision engine of a process controller generates the proposition determination commands. The wagering subcontroller receives the proposition determination commands and executes the proposition determination commands to generate the chance-based wager outcome.

In various embodiments, the process controller 104 uses a rule-based decision engine to automatically determine an amount of application credits to award to a user based at least in part on the application telemetry data 106 including skill outcome data and user interaction data with the interactive application 110 of the variable skill reward wagering system. In numerous embodiments, the interactive application 110 is a skill-based interactive application and the application credits are awarded for a user's skillful interaction with the interactive application 110.

In some embodiments, the wagering subcontroller 136 uses a wagering user interface generator 148 to automatically generate wagering telemetry data 150 on the basis of amounts of credits on the one or more credit meter datastores 142. The wagering telemetry data 150 is used by the process controller 104 to command the interactive controller 102 to automatically generate one or more wagering user interfaces 152 describing a state of wagered credit accumulation and loss for the variable skill reward wagering system. When a user interacts with the one or more wagering user interfaces 152, wagering user interface telemetry data 150 is generated by the one or more wagering user interfaces 152 and communicated by the interactive controller 102 to the process controller 104 using interfaces 122 and 124.

In some embodiments, the wagering telemetry data 150 may include, but is not limited to, amounts of application credits and interactive elements earned, lost or accumulated through interaction with the interactive application 110, and credits, application credits and interactive elements amounts awarded, lost or accumulated.

In some embodiments, the skill proposition data, interactive application command data, and/or resource data 108 are communicated to the wagering user interface generator 148 and used as a partial basis for generation of the wagering telemetry data 150 communicated to the interactive controller 102.

In various embodiments, the wagering user interface generator 148 also receives chance-based wager outcome data that is used as a partial basis for generation of the wagering telemetry data 150 communicated to the interactive controller 102. In some embodiments, the chance-based wager outcome data also includes data about one or more states of a wager of the chance-based wager proposition as generated by the wagering subcontroller 136. In various such embodiments, the wagering user interface generator 148 generates a chance-based wager outcome generation process display and/or chance-based wager outcome state display using the one or more states of the chance-based wager outcome. The chance-based wager outcome generation process display and/or chance-based wager outcome state display is included in the wagering telemetry data 150 that is communicated to the interactive controller 102. The wagering process display and/or wagering state display is automatically displayed by the interactive controller 102 using the one or more wagering user interfaces 152. In other such embodiments, the one or more states of the chance-based wager outcome are communicated to the interactive controller 102 and the interactive controller 102 is instructed to automatically generate the chance-based wager outcome generation process display and/or chance-based wager outcome state display of the one or more wagering user interfaces 152 using the one or more states of the chance-based wager outcome for display.

In some embodiments, the chance-based wager outcome includes state data about execution of a chance-based wager proposition of the chance-based wager proposition logic 134, including but not limited to a final state, intermediate state and/or beginning state of the chance-based wager proposition. For example, in a chance-based wager proposition that is based on slot machine math, the final state of the chance-based wager proposition may be reel positions, in a chance-based wager proposition that is based on roulette wheel math, the final state may be a pocket where a ball may have come to rest, in a chance-based wager proposition that is a based on card math, the beginning, intermediate and final states may represent a sequence of cards being drawn from a deck of cards, etc.

In some embodiments, an interactive controller generates a wagering user interface by executing commands that define processes of the wagering user interface where the commands are formatted in a scripting language. In operation, a wagering user interface generator of a process controller generates commands in the form of a script written in the scripting language. The script includes commands that describe how the interactive controller is to display wagering outcome data. The completed script is encoded as wagering telemetry data and communicated to the interactive controller by the process controller. The interactive controller receives the wagering telemetry data and parses the script encoded in the wagering telemetry data and executes the commands included in the script to generate the wagering user interface.

In many embodiments, an interactive controller generates a wagering user interface based on a document written in a document markup language that includes commands that define processes of the wagering user interface. In operation, a wagering user interface generator of a process controller generates a document composed in the document markup language. The document includes commands that describe how the interactive controller is to display wagering outcome data. The completed document is encoded as wagering telemetry data and communicated to the interactive controller by the process controller. The interactive controller receives the wagering telemetry data and parses the document encoded in the wagering telemetry data and executes the commands encoded into the document to generate the wagering user interface.

In some embodiments, an interactive controller generates a wagering user interface by executing commands that define processes of the wagering user interface. In operation, a wagering user interface generator of a process controller generates the commands and encodes the commands into wagering telemetry data that is communicated to the interactive controller by the process controller. The interactive controller receives the wagering telemetry data and executes the commands encoded in the wagering telemetry data to generate the wagering user interface.

In various embodiments, an interactive controller includes a data store of graphic and audio display resources that the interactive controller uses to generate a wagering user interface as described herein.

In many embodiments, a process controller communicates graphic and audio display resources as part of wagering telemetry data to an interactive controller. The interactive controller uses the graphic and audio display resources to generate a wagering user interface as described herein.

In many embodiments, the process controller 104 may additionally include various audit logs and activity meter datastores.

The process controller 104 can further operatively connect to a metering sub-controller to determine an amount of credit or interactive elements available and other wagering metrics of a combined wagering proposition. Thus, the process controller 104 may potentially affect an amount of credits in play for participation in the wagering events of the combined wagering proposition provided by the wagering subcontroller. In some embodiments, the process controller 104 can also couple to a centralized server for exchanging various data related to users and the activities of the users during utilization of a variable skill reward wagering system.

In a number of embodiments, communication of chance-based wager outcome determination commands between the wagering subcontroller 136 and the process controller 104 can further be used to communicate various wagering control factors that the wagering subcontroller uses as input. Examples of wagering control factors include, but are not limited to, an amount of credits, amount of application credits, amount of interactive elements, or amounts of objects consumed wager, and/or a user's election to enter a jackpot round.

In many embodiments, two or more users can be engaged in using the interactive application 110 executed by the interactive controller 102. In various embodiments, a variable skill reward wagering system can include an interactive application 110 that provides a skill-based interactive application that includes head-to-head play between a single user and a computing device, between two or more users against one another, or multiple users playing against a computer device and/or each other. In some embodiments, the interactive application 110 can be a skill-based interactive application where the user is not skillfully playing against the computer or any other user such as skill-based interactive applications where the user is effectively skillfully playing against himself or herself.

In some embodiments, the process controller 104 utilizes the one or more wagering user interfaces 152 to communicate certain interactive application data to the user, including but not limited to, club points, user status, control of the selection of choices, and messages which a user can find useful in order to adjust the interactive application experience or understand the wagering status of the user.

In some embodiments, the process controller 104 utilizes the one or more wagering user interfaces 152 to communicate aspects of a combined wagering proposition to a user including, but not limited to, amount of credits, application credits, interactive elements, or objects in play, and amounts of credits, application credits, interactive elements, or objects available.

In a number of embodiments, the wagering subcontroller 136 can accept combined wagering proposition factors including, but not limited to, modifications in the amount of credits, application credits, interactive elements, or objects wagered on each individual wagering event, entrance into a variable skill reward round, and other factors. In several embodiments, the process controller 104 can communicate a number of factors back and forth to the wagering subcontroller, such that an increase/decrease in a wagered amount can be related to the change in user profile of the user in the interactive application. In this manner, a user can control a wager amount per wagering event in accordance with the combined wagering proposition with the change mapping to a parameter or component that is applicable to the interactive application experience.

In some embodiments, the process controller 104 includes a session sub-controller 154 is used to regulate a variable skill reward wagering system session.

In various embodiments, the session sub-controller 154 includes one or more session sub-controller interfaces that operatively connect the session sub-controller 154 to one or more variable skill reward bet sub-controllers through their respective interfaces.

In some embodiments, one or more of the session sub-controller interfaces implement a session sub-controller to device or server communication protocol employing an interprocess communication protocol so that the session sub-controller and one or more of an interactive controller, a wagering subcontroller, and/or a process controller may be implemented on the same device. In operation, the session sub-controller interfaces provide application programming interfaces or the like that are used by the session sub-controller to communicate outgoing data and receive incoming data by passing parameter data to another process or application running on the same device.

In some embodiments, one or more of the session sub-controller interfaces implement a session sub-controller communication protocol employing an interdevice communication protocol so that the session sub-controller may be implemented on a device separate from the one or more interactive controllers, the one or more process controllers and/or the one or more wagering subcontrollers. The interdevice protocol may utilize a wired communication bus or wireless connection as a physical layer. In various embodiments, one or more of the session sub-controller interfaces implement a session sub-controller communication protocol employing a networking protocol so that the process session sub-controller may be operatively connected to the one or more interactive controllers, the one or more process controllers, and/or the one or more wagering subcontrollers by a network. The networking protocol may utilize a wired communication bus or wireless connection as a physical layer. In many such embodiments, the network includes a cellular telephone network or the like and the one or more interactive controllers include a mobile device such as a smartphone or other device capable of using the telephone network. During operation, the one or more session sub-controller interfaces communicate outgoing data to an external device or server by encoding the data into a signal and transmitting the signal to the external device or server. The one or more session sub-controller interfaces receive incoming data from an external device or server by receiving a signal transmitted by the external device or server and decoding the signal to obtain the incoming data.

In various embodiments, components of the process controller 104 communicate session data to the session sub-controller. The session data may include, but is not limited to, user data, interactive controller data, pooled bet and side bet data, process controller data and wagering subcontroller data used by the session sub-controller to regulate a variable skill reward wagering system session.

In some embodiments, the session sub-controller 154 may also assert control of a variable skill reward wagering system session by communicating session control data to components of the process controller 104. Such control may include, but is not limited to, commanding the process controller 104 to end a variable skill reward wagering system session, initiating wagering in a variable skill reward wagering system session, ending wagering in a variable skill reward wagering system session but not ending a user's use of the interactive application portion of the variable skill reward wagering system, and changing from real credit wagering in a variable skill reward wagering system to virtual credit wagering, or vice versa.

In many embodiments, the session sub-controller 154 manages user profiles for a plurality of users. The session sub-controller 154 stores and manages data about users in order to provide authentication and authorization of users of the variable skill reward wagering system 100. In some embodiments, the session sub-controller 154 also manages geolocation information to ensure that the variable skill reward wagering system 100 is only used by users in jurisdictions were wagering is approved. In various embodiments, the session sub-controller 154 stores application credits that are associated with the user's use of the interactive application of the variable skill reward wagering system 100.

In some embodiments, the session sub-controller 154 communicates user and session management data to the user using a management user interface (not shown) of the interactive controller. The user interacts with the management user interface and the management user interface generates management telemetry data that is communicated to the session sub-controller 154 via interfaces 122 and 124.

In some embodiments, the wagering subcontroller 136 communicates wagering session data to the session sub-controller 154. In various embodiments, the session sub-controller communicates wagering session control data to the wagering subcontroller 136.

In many embodiments, a variable skill reward wagering system includes a variable skill reward controller 162 operatively connected to a process controller 104 via a one or more interfaces 160. The variable skill reward controller includes variable skill reward outcome allocation rules 164 for allocating a variable skill reward outcome of credits to a user when the process controller 104 requests that the variable skill reward outcome be generated. The variable skill reward controller 162 further includes one or more skill reward pool credit meter datastores 166 for storing data about one or more pools of variable skill reward credits that are available to provide to user as a variable skill reward outcome. The variable skill reward controller further includes a datastore 168 such as a database for storing data about promotion pools of credits. In some embodiments, the variable skill reward controller supports a plurality of types of skill-based games provided by one or more interactive applications, such as interactive application 110. In many embodiments, the datastore is used to store data of skill metrics of user's skillful play of a skill-based game provided the interactive application 110. In various embodiments, the datastore further stores data of wagering metrics of users' wagering when using the variable skill reward wagering system.

In some embodiments, a process controller operates as an interface between an interactive controller and a wagering subcontroller. By virtue of this construction, the wagering subcontroller is isolated from the interactive controller allowing the interactive controller to operate in an unregulated environment while allowing the wagering subcontroller to operate in a regulated environment.

In some embodiments, a single wagering subcontroller may provide services to two or more interactive controllers and/or two or more process controllers, thus allowing a variable skill reward wagering system to operate over a large range of scaling.

In various embodiments, multiple types of interactive controllers using different operating systems may be interfaced to a single type of process controller and/or wagering subcontroller without requiring customization of the process controller and/or the wagering subcontroller.

In many embodiments, an interactive controller may be provided as a user device under control of a user while maintaining the wagering subcontroller in an environment under the control of a regulated operator of wagering equipment.

In several embodiments, data communicated between the controllers may be encrypted to increase security of the variable skill reward wagering system.

In some embodiments, a process controller isolates chance-based wager proposition logic and skill proposition logic as unregulated logic from a regulated wagering sub-controller, thus allowing errors in the skill proposition logic and/or chance-based wager proposition logic to be corrected, new skill proposition logic and/or chance-based wager proposition logic to be used, or modifications to be made to the skill proposition logic and/or chance-based wager proposition logic without a need for regulatory approval.

In various embodiments, an interactive application may require extensive processing resources from an interactive controller leaving few processing resources for the functions performed by a process controller and/or a wagering sub-controller. By virtue of the architecture described herein, processing loads may be distributed across multiple devices such that operations of the interactive controller may be dedicated to the interactive application and the processes of the process controller and/or wagering subcontroller are not burdened by the requirements of the interactive application.

In many embodiments, a variable skill reward wagering system operates with its components being distributed across multiple devices. These devices can be connected by communication channels including, but not limited to, local area networks, wide area networks, local communication buses, and/or the like. The devices may communicate using various types of protocols, including but not limited to, networking protocols, device-to-device communications protocols, and the like.

In some embodiments, one or more components of a variable skill reward wagering system are distributed in close proximity to each other and communicate using a local area network and/or a communication bus. In several embodiments, an interactive controller and a process controller of a variable skill reward wagering system are in a common location and communicate with an external wagering subcontroller. In some embodiments, a process controller and a wagering subcontroller of a variable skill reward wagering system are in a common location and communicate with an external interactive controller. In many embodiments, an interactive controller, a process controller, and a wagering subcontroller of a variable skill reward wagering system are located in a common location. In some embodiments, a session sub-controller is located in a common location with a process controller and/or a wagering sub-controller.

In various embodiments, these multiple devices can be constructed from or configured using a single device or a plurality of devices such that a variable skill reward wagering system is executed as a system in a virtualized space such as, but not limited to, where a wagering subcontroller and a process controller are large scale centralized servers in the cloud operatively connected to widely distributed interactive controllers via a wide area network such as the Internet or a local area network. In such embodiments, the components of a variable skill reward wagering system may communicate using a networking protocol or other type of device-to-device communications protocol.

In some embodiments, a variable skill reward wagering system is deployed over a local area network or a wide area network in an interactive configuration. An interactive configuration of a variable skill reward wagering system includes an interactive controller operatively connected by a network to a process controller and a wagering subcontroller.

In some embodiments, a variable skill reward wagering system is deployed over a local area network or a wide area network in a mobile configuration. A mobile configuration of a variable skill reward wagering system is useful for deployment over wireless communication network, such as a wireless local area network or a wireless telecommunications network. A mobile configuration of a variable skill reward wagering system includes an interactive controller operatively connected by a wireless network to a process controller and a wagering subcontroller.

In several embodiments, a centralized process controller is operatively connected to one or more interactive controllers and one or more wagering subcontrollers using a communication link. The centralized process controller can perform the functionality of a process controller across various variable skill reward wagering systems.

In numerous embodiments, an interactive application server provides a host for managing head-to-head play operating over a network of interactive controllers connected to the interactive application server using a communication link. The interactive application server provides an environment where users can compete directly with one another and interact with other users.

In many embodiments, the credit processing system 105 operatively connects to one or more credit input devices for generating incoming credit data from a credit input. Credit inputs can include, but are not limited to, credit items used to transfer credits. The incoming credit data are communicated by the credit processing system 105 to the metering sub-controller 140. In various embodiments, the one or more credit input devices and their corresponding credit items include, but are not limited to: card readers for reading cards having magnetic stripes, RFID chips, smart chips, and the like; scanners for reading various types of printed indicia printed on to various types of media such as vouchers, coupons, TITO tickets, rewritable cards, or the like; and bill validator and/or coin validators that receive and validate paper and/or coin currency or tokens.

In various embodiments, the credit processing system 105 includes one or more credit output devices 146 for generating a credit output based on outgoing credit data 192 communicated from the wagering subcontroller. Credit outputs can include, but are not limited to, credit items used to transfer credits. Types of credit output devices and their corresponding credit items may include, but are not limited to: writing devices that are used to write to cards having magnetic stripes, smart chips or the like; printers for printing various types of printed indicia onto vouchers, coupons, TITO tickets, vouchers, rewritable cards or the like; and bill and/or coin dispensers that output paper and/or coin currency or tokens.

In some embodiments, the credit processing system 105 is operatively connected to, and communicates with, a TITO controller or the like to determine incoming credit data representing amounts of credits to be transferred into the variable skill reward wagering system and to determine outgoing credit data representing amounts of credits to be transferred out of the variable skill reward wagering system. In operation, the credit processing system 105 communicates with a connected credit input device, such as a bill validator/ticket scanner, used to scan a credit input in the form of a TITO ticket having indicia of credit account data of a credit account of the TITO controller. The credit processing system 105 communicates the credit account data to the TITO controller. The TITO controller uses the credit account data to determine an amount of credits to transfer to the credit processing system 105, and thus to the metering sub-controller 140 of the process controller 104. The TITO controller communicates the amount of credits to the credit processing system 105. The credit processing system 105 communicates the amount of credits as incoming credit data to the metering sub-controller 140 and the metering sub-controller 140 credits one or more credit meter datastores 142 with the amount of credits so that the credits can be used when a user makes wagers using the variable skill reward wagering system 100.

In many embodiments, the credit processing system 105 is operatively connected to a bill validator/ticket scanner as one of the one or more credit input devices 144. The credit processing system 105 communicates with the bill validator/ticket scanner to scan currency used as a credit input to determine an amount of credits as incoming credit data to transfer credit to one or more credit meter datastores 110 associated with one or more users. The skill metering sub-controller 140 credits the one or more credit meter datastores 110 with the amount of credits so that the credits can be used when a user makes wagers using the variable skill reward wagering system 100.

In some embodiments, the credit processing system 105 can use a TITO controller along with a ticket or voucher printer as one of the one or more credit output devices 146 to generate a TITO ticket as a credit output for a user. In operation, the credit processing system 105 communicates, as outgoing credit data, data of an amount of credits to be credited to a credit account on the TITO controller. The TITO controller receives the amount of credits and creates the credit account and credits the credit account with the amount of credits. The TITO controller generates credit account data for the credit account and communicates the credit account data to the credit processing system 105. The credit processing system 105 uses the ticket or voucher printer to print indicia of the credit account data onto a TITO ticket or voucher as a credit output.

In various embodiments, a credit processing interface 156 resident in the credit processing system 105 provides an interface between the credit processing system 156 and the process controller 104.

In some embodiments, the application control interface 122 implements a credit processing system to process controller communication protocol employing an interprocess communication protocol so that the interactive controller 104 and the credit processing system 105 may be implemented on the same device. In operation, the credit processing interface 156 provides application programming interfaces that are used by the credit processing system 105 to communicate outgoing data and receive incoming data by passing parameter data to another process or application.

In some embodiments, the credit processing interface 156 implements an interactive controller to credit processing system communication protocol employing an interdevice communication protocol so that the interactive controller and the credit processing system may be implemented on different devices. The interdevice protocol may utilize a wired communication bus or wireless connection as a physical layer.

In various embodiments, the credit processing interface 156 implements an interactive controller to credit processing system communication protocol employing a networking protocol so that the interactive controller 104 and the credit processing system 105 may be implemented on different devices connected by a network. The networking protocol may utilize a wired communication bus or wireless connection as a physical layer. During operation, the credit processing interface 156 communicates outgoing data to an external device by encoding the data into a signal and transmitting the signal to an external device. The application control interface receives incoming data from an external device by receiving a signal transmitted by the external device and decoding the signal to obtain the incoming data.

In various embodiments, the credit processing system 105 provides an interface to an electronic payment management system (not shown) such as an electronic wallet or the like. The electronic payment system provides credit account data that is used for generating incoming credit data as a credit input and outgoing credit data as a credit output.

Figure 2A:
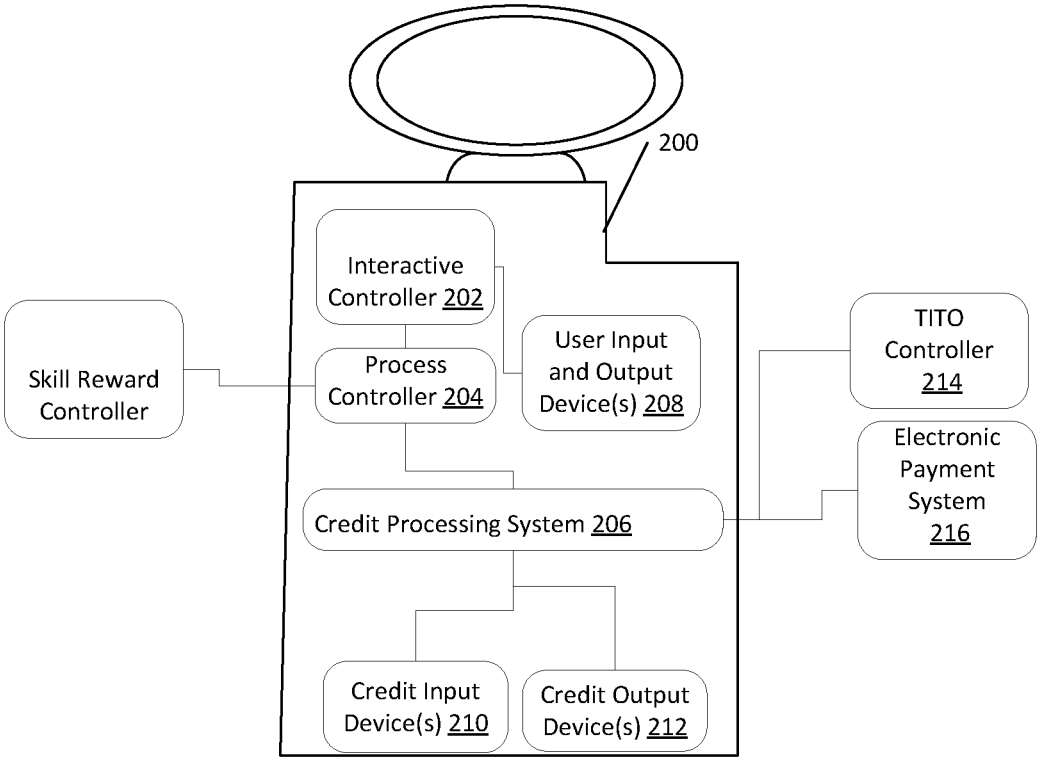
FIG. 2A is a diagram of an electronic gaming machine configuration of a variable skill reward wagering system in accordance with various embodiments of the invention.

FIG. 2A is a diagram of an electronic gaming machine configuration of a variable skill reward wagering system in accordance with various embodiments of the invention. Electronic gaming machine configurations of a variable skill reward wagering system include, but are not limited to, electronic gaming machines such as slot machines, table games, video arcade consoles and the like. An electronic gaming machine configuration of a variable skill reward wagering system 200 includes an interactive controller 202, a process controller 204 and a credit processing system 206 contained in an enclosure such as a housing, cabinet, casing or the like. The enclosure may further include one or more user accessible openings or surfaces that may be used to mount one or more user accessible user input devices and user output devices 208, one or more user accessible credit input devices 210 and one or more credit output devices 212. The interactive controller 202 communicates with the user input devices to detect user interactions with the variable skill reward wagering system and commands and controls the user output devices to provide a user interface to one or more users of the variable skill reward wagering system as described herein. The process controller 204 communicates with the credit processing system 206 or user credit processing devices 210 and 212 to transfer credits into and out of the variable skill reward wagering system as described herein.

In many embodiments, the process controller 204 is operatively connected to an external session sub-controller (not shown). The session sub-controller may provide session control for a wagering session or may provide services for management of a user account for the storage of player points, application credits and the like.

In various embodiments, the process controller 204 is operatively connected to the credit processing system 206. In many embodiments, the credit processing system 206 is operatively connected to one or more credit input devices 210 for generating incoming credit data from a credit input as described herein. The incoming credit data are communicated to the process controller 204. In various embodiments, the one or more credit input devices and their corresponding credit items include, but are not limited to: card readers for reading cards having magnetic stripes, RFID chips, smart chips, and the like; scanners for reading various types of printed indicia printed on to various types of media such as vouchers, coupons, TITO tickets, rewritable cards, or the like; and bill validators and/or coin validators that receive and validate paper and/or coin currency or tokens.

In various embodiments, the credit processing system 206 is operatively connected to the one or more credit output devices 212 for generating a credit output based on outgoing credit data communicated from the process controller 204. Credit outputs can include, but are not limited to, credit items used to transfer credits. Types of credit output devices and their corresponding credit items may include, but are not limited to: writing devices that are used to write to cards having magnetic stripes, smart chips or the like; printers for printing various types of printed indicia onto vouchers, coupons, TITO tickets, vouchers, rewritable cards or the like; and bill and/or coin dispensers that output paper and/or coin currency or tokens.

In some embodiments, the credit processing system 206 is operatively connected to, and communicates with, a TITO controller 214 or the like to determine incoming credit data representing amounts of credits to be transferred into the variable skill reward wagering system 200 and to determine outgoing credit data representing amounts of credits to be transferred out of the variable skill reward wagering system 200. In operation, the credit processing system 206 communicates with one of the one or more connected credit input devices 210, such as a bill validator/ticket scanner, used to scan a credit input in the form of a TITO ticket having indicia of credit account data of a credit account of the TITO controller 214. The credit processing system 206 communicates the credit account data to the TITO controller 214. The TITO controller 214 uses the credit account data to determine an amount of credits to transfer to the credit processing system 206 of the variable skill reward wagering system 200. The TITO controller 214 communicates the amount of credits to the credit processing system 206. The credit processing system 206 communicates the amount of credits as incoming credit data to the process controller 204 which credits one or more credit meter datastores with the amount of credits so that the credits can be used when a user makes wagers using the variable skill reward wagering system 200.

In many embodiments, the credit processing system 206 includes a bill validator/ticket scanner as one of the one or more credit input devices 210. The credit processing system 206 communicates with the bill validator/ticket scanner to scan currency used as a credit input to determine an amount of credits as incoming credit data to transfer credit to one or more credit meter datastores associated with one or more users. The process controller 204 credits the one or more credit meter datastores with the amount of credits so that the credits can be used when a user makes wagers using the variable skill reward wagering system 200.

In some embodiments, the credit processing system 206 can use the TITO controller 214 along with a ticket or voucher printer as one of the one or more credit output devices 212 to generate a TITO ticket as a credit output for a user. In operation, the credit processing system 206 communicates, as outgoing credit data, data of an amount of credits to be credited to a credit account on the TITO controller 214. The TITO controller 214 receives the amount of credits and creates the credit account and credits the credit account with the amount of credits. The TITO controller 214 generates credit account data for the credit account and communicates the credit account data to the credit processing system 206. The credit processing system 206 uses the ticket or voucher printer to print indicia of the credit account data onto a TITO ticket as a credit output.

In various embodiments, the credit processing system 206 provides an interface to an electronic payment system 216 such an electronic wallet or the like. The electronic payment system 216 provides credit account data that is used for generating incoming credit data as a credit input and outgoing credit data as a credit output.

In some embodiments, the process controller 204 is operatively connected to a central determination controller (not shown). In operation, when a wagering subcontroller of the process controller 204 needs to determine a random outcome, the wagering subcontroller communicates a request to the central determination controller for the random outcome. The central determination controller receives the random outcome request and generates a random outcome in response to the random outcome request. The central determination controller communicates data of the random outcome to the process controller 204. The processing controller 204 receives the data of the random outcome and utilizes the random outcome as described herein. In some embodiments, the random outcome is drawn from a pool of pre-determined random outcomes.

In various embodiments, the wagering process controller 204 may be operatively connected to a variable skill reward controller along with one or more other process controllers of one or more other variable skill reward wagering systems. The variable skill reward controller provides services for the collection and provision of credits used by the process controller 204 to provide random outcomes that have a variable skill reward pooling component.

Figure 2B:
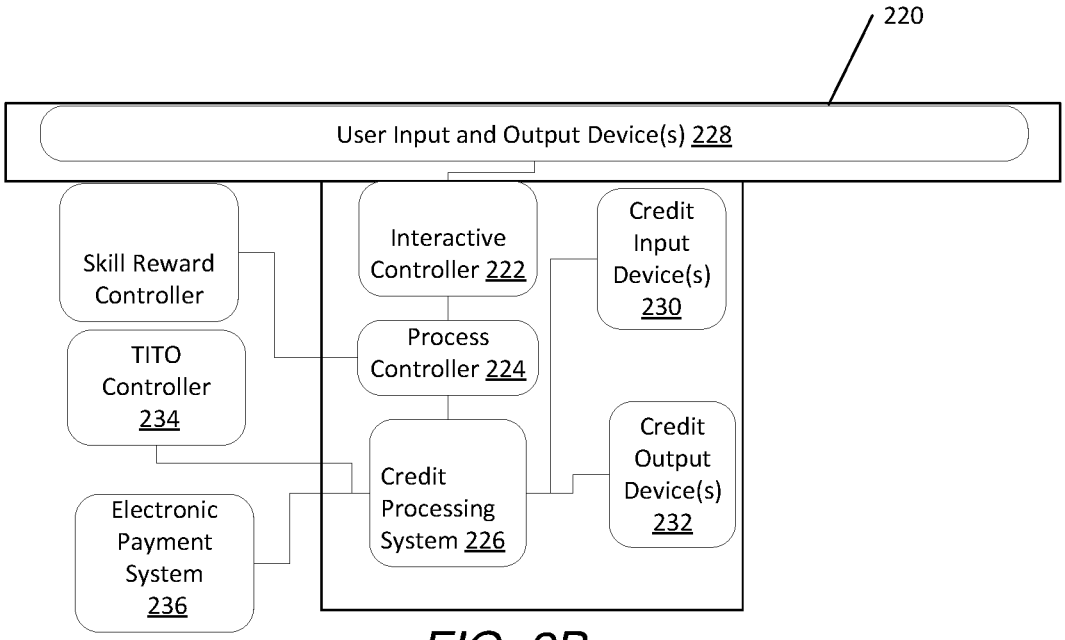
FIG. 2B is a diagram of a table electronic gaming machine configuration of a variable skill reward wagering system in accordance with various embodiments of the invention.

FIG. 2B is a diagram of multiuser electronic gaming machine configuration of a variable skill reward wagering system in accordance with various embodiments of the invention. Types of a multiuser electronic gaming machine configuration a variable skill reward wagering system include, but are not limited to, multiuser electronic gaming machines, multiuser slot machines, multiuser table gaming devices, multi user video arcade consoles and the like. A multiuser electronic gaming machine configuration of a variable skill reward wagering system 220 includes an interactive controller 222, a process controller 224 and a credit processing system 226 contained in an enclosure such as a housing, cabinet, casing or the like. The enclosure may further include one or more user accessible openings or surfaces that may be used to mount one or more user accessible user input devices and user output devices 228, one or more user accessible credit input devices 230 and one or more user accessible credit output devices 212.

In some embodiments, two or more sets of credit input devices and credit output devices are provided so that each user of the multiuser electronic gaming machine configuration of a variable skill reward wagering system 220 can have an associated set of credit input devices and credit output devices.

The interactive controller 222 communicates with the user input devices to detect user interactions with the variable skill reward wagering system and commands and controls the user output devices to provide a user interface to one or more users of the variable skill reward wagering system as described herein. The process controller 224 communicates with the credit processing system 226 or user credit processing devices 230 and 232 to transfer credits into and out of the variable skill reward wagering system as described herein.

In many embodiments, the process controller 224 is operatively connected to an external session sub-controller (not shown). The session sub-controller may provide session control for a wagering session or may provide services for management of a user account for the storage of player points, application credits and the like.

In various embodiments, the process controller 224 is operatively connected to the credit processing system 226. In many embodiments, the credit processing system 226 is operatively connected to one or more credit input devices 230 for generating incoming credit data from a credit input as described herein. The incoming credit data are communicated to the process controller 224. In various embodiments, the one or more credit input devices and their corresponding credit items include, but are not limited to: card readers for reading cards having magnetic stripes, RFID chips, smart chips, and the like; scanners for reading various types of printed indicia printed on to various types of media such as vouchers, coupons, TITO tickets, rewritable cards, or the like; and bill validators and/or coin validators that receive and validate paper and/or coin currency or tokens.

In various embodiments, the credit processing system 226 is operatively connected to the one or more credit output devices 232 for generating a credit output based on outgoing credit data communicated from the process controller 224. Credit outputs can include, but are not limited to, credit items used to transfer credits. Types of credit output devices and their corresponding credit items may include, but are not limited to: writing devices that are used to write to cards having magnetic stripes, smart chips or the like; printers for printing various types of printed indicia onto vouchers, coupons, TITO tickets, vouchers, rewritable cards or the like; and bill and/or coin dispensers that output paper and/or coin currency or tokens.

In some embodiments, the credit processing system 226 is operatively connected to, and communicates with, a TITO controller 234 or the like to determine incoming credit data representing amounts of credits to be transferred into the variable skill reward wagering system 220 and to determine outgoing credit data representing amounts of credits to be transferred out of the variable skill reward wagering system 220. In operation, the credit processing system 226 communicates with one of the one or more connected credit input devices 230, such as a bill validator/ticket scanner, used to scan a credit input in the form of a TITO ticket having indicia of credit account data of a credit account of the TITO controller 234. The credit processing system 226 communicates the credit account data to the TITO controller 234. The TITO controller 234 uses the credit account data to determine an amount of credits to transfer to the credit processing system 226 of the variable skill reward wagering system 220. The TITO controller 234 communicates the amount of credits to the credit processing system 226. The credit processing system 226 communicates the amount of credits as incoming credit data to the process controller 224 which credits one or more credit meter datastores with the amount of credits so that the credits can be used when a user makes wagers using the variable skill reward wagering system 220.

In many embodiments, the credit processing system 226 includes a bill validator/ticket scanner as one of the one or more credit input devices 230. The credit processing system 226 communicates with the bill validator/ticket scanner to scan currency used as a credit input to determine an amount of credits as incoming credit data to transfer credit to one or more credit meter datastores associated with one or more users. The process controller 224 credits the one or more credit meter datastores with the amount of credits so that the credits can be used when a user makes wagers using the variable skill reward wagering system 220.

In some embodiments, the credit processing system 226 can use the TITO controller 234 along with a ticket or voucher printer as one of the one or more credit output devices 232 to generate a TITO ticket as a credit output for a user. In operation, the credit processing system 226 communicates, as outgoing credit data, data of an amount of credits to be credited to a credit account on the TITO controller 234. The TITO controller 234 receives the amount of credits and creates the credit account and credits the credit account with the amount of credits. The TITO controller 234 generates credit account data for the credit account and communicates the credit account data to the credit processing system 226. The credit processing system 226 uses the ticket or voucher printer to print indicia of the credit account data onto a TITO ticket as a credit output.

In various embodiments, the credit processing system 226 provides an interface to an electronic payment system 236 such an electronic wallet or the like. The electronic payment system 236 provides credit account data that is used for generating incoming credit data as a credit input and outgoing credit data as a credit output.

In some embodiments, the process controller 224 is operatively connected to a central determination controller (not shown). In operation, when a wagering subcontroller of the process controller 224 needs to determine a random outcome, the wagering subcontroller communicates a request to the central determination controller for the random outcome. The central determination controller receives the random outcome request and generates a random outcome in response to the random outcome request. The central determination controller communicates data of the random outcome to the process controller 224. The processing controller 224 receives the data of the random outcome and utilizes the random outcome as described herein. In some embodiments, the random outcome is drawn from a pool of pre-determined random outcomes.

In various embodiments, the wagering process controller 224 may be operatively connected to a variable skill reward controller along with one or more other process controllers of one or more other variable skill reward wagering systems. The variable skill reward controller provides services for the collection and provision of credits used by the process controller 224 to provide random outcomes that have a variable skill reward pooling component.

Figure 3:
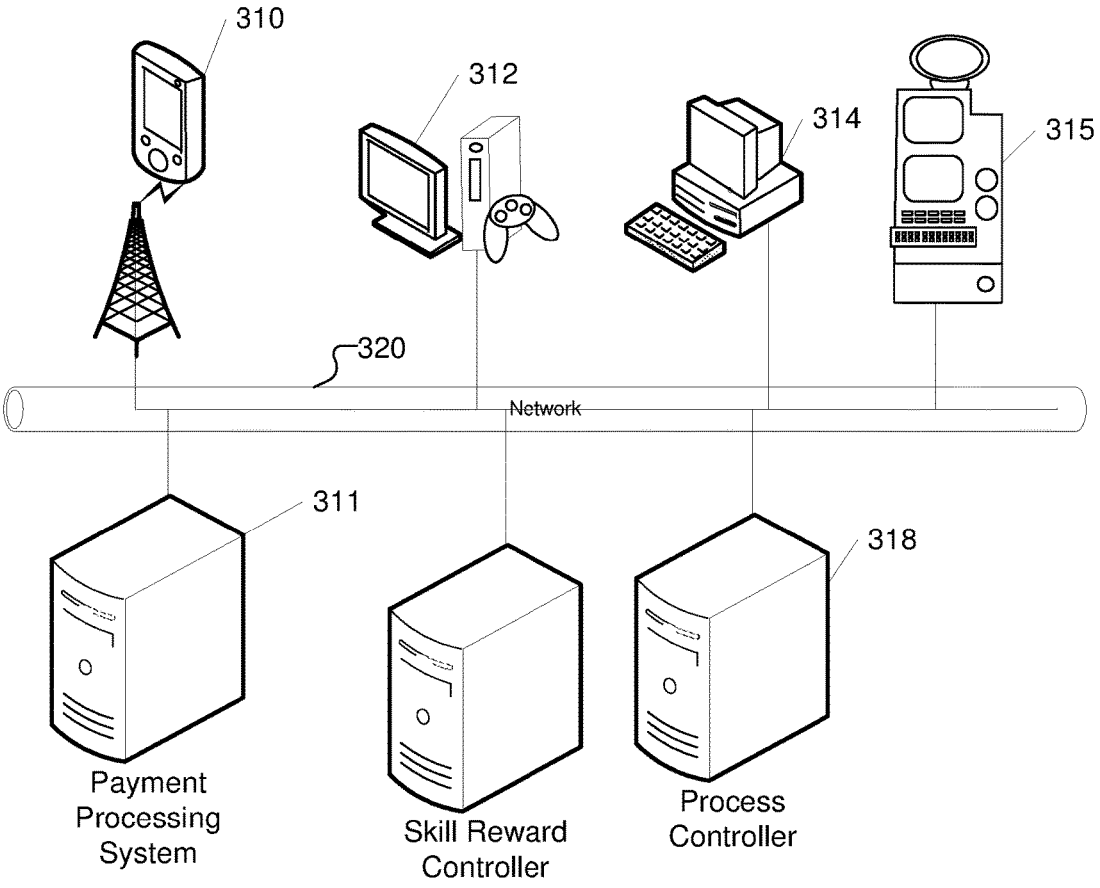
FIG. 3 is a diagram of distributed variable skill reward wagering systems in accordance with various embodiments of the invention.

FIG. 3 is a diagram of distributed variable skill reward wagering systems in accordance with various embodiments of the invention. An interactive controller, such as interactive controller 102 of FIG. 1, may be constructed from or configured using one or more processing devices that perform the operations of the interactive controller. An interactive controller in a distributed variable skill reward wagering system may be constructed from or configured using any processing device having sufficient processing and communication capabilities that may be that perform the processes of an interactive controller in accordance with various embodiments of the invention. In some embodiments, the construction or configuration of the interactive controller may be achieved through the use of an application control interface, such as application control interface 122 of FIG. 1, and/or through the use of an interactive application, such as interactive application 110 of FIG. 1.

In some embodiments, an interactive controller may be constructed from or configured using an electronic gaming machine 315, such as a slot machine or the like. The electronic gaming machine 315 may be physically located in various types of gaming establishments.

In many embodiments, an interactive controller may be constructed from or configured using a portable device 310. The portable device 310 is a device that may wirelessly connect to a network. Examples of portable devices include, but are not limited to, a tablet computer, a personal digital assistant, and a smartphone.

In some embodiments, an interactive controller may be constructed from or configured using a gaming console 312.

In various embodiments, an interactive controller may be constructed from or configured using a personal computer 314.

In some embodiments, one or more processing devices, such as devices 310, 312, 314 and 315, may be used to construct a complete variable skill reward wagering system and may be operatively connected using a communication link to a session and/or management controller.

Some variable skill reward wagering systems in accordance with many embodiments of the invention can be distributed across a plurality of devices in various configurations. One or more interactive controllers of a distributed variable skill reward wagering system, such as but not limited to, a mobile or wireless device 310, a gaming console 312, a personal computer 314, and an electronic gaming machine 315, are operatively connected with a process controller 318 of a distributed variable skill reward wagering system using a communication link 320.

Communication link 320 is a communications link that allows processing systems to communicate with each other and to share data. Embodiments of a communication link include, but are not limited to: a wired or wireless interdevice communication link; a serial or parallel interdevice communication bus; a wired or wireless network such as a Local Area Network (LAN), a Wide Area Network (WAN), or the link; or a wired or wireless communication network such as a wireless telecommunications network or plain old telephone system (POTS). In some embodiments, one or more processes of an interactive controller and a process controller as described herein are executed on the individual interactive controllers 310, 312, 314 and 315 while one or more processes of a process controller as described herein can be executed by the process controller 318.

In many embodiments, a distributed variable skill reward wagering system and may be operatively connected using a communication link to a session controller (not shown), that performs the processes of a session controller as described herein.

In several embodiments, a distributed variable skill reward wagering system and may be operatively connected using a communication link to credit processing system 311, that performs the processes of one or more credit processing systems as described herein.

In various embodiments, one or more distributed variable skill reward wagering systems may be operatively connected to a variable skill reward controller. The variable skill reward controller provides services for the collection and provision of credits used to provide random outcomes that have a variable skill reward pooling component.

Figure 4A:
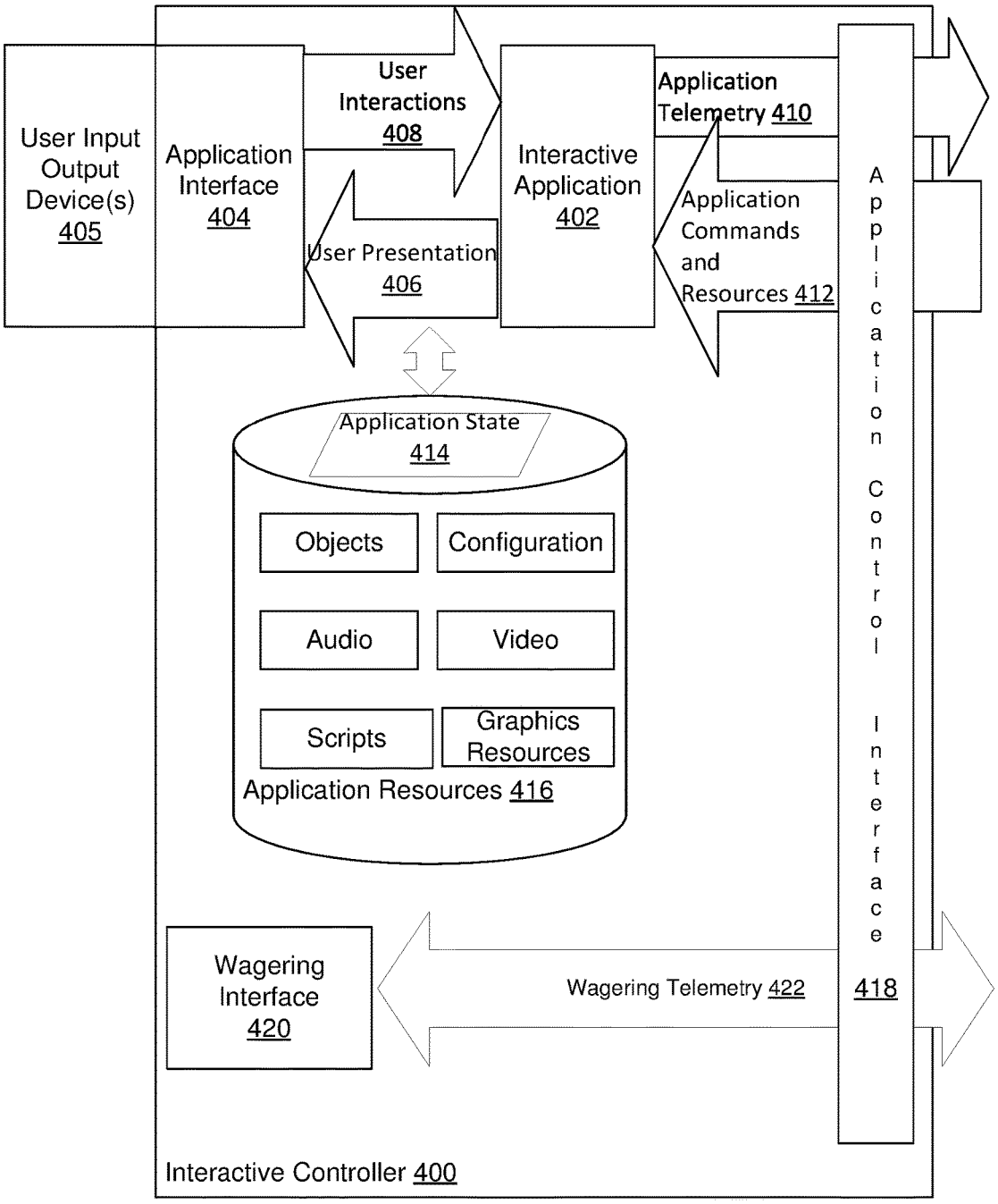
FIGS. 4A and 4B are diagrams of a structure of an interactive controller of a variable skill reward wagering system in accordance with various embodiments of the invention.

Referring now to FIG. 4A, an interactive controller 400, suitable for use as interactive controller 102 of FIG. 1, provides an execution environment for an interactive application 402 of a variable skill reward wagering system. In several embodiments, an interactive controller 400 of a variable skill reward wagering system provides an interactive application 402 that generates an application interface 404 for interaction with by a user. The interactive application 402 generates a user presentation 406 that is presented to the user through the application interface 404 using one or more user input and output devices 405. The user presentation 406 may include audio features, visual features or tactile features, or any combination of these features. In various embodiments, the application interface 404 utilizes one or more user interface input and output devices 405 so that a user can interact with the user presentation 406. In various embodiments, user interface input devices include, but are not limited to: buttons or keys; keyboards; keypads; game controllers; joysticks; computer mice; track balls; track buttons; touch pads; touch screens; accelerometers; motion sensors; video input devices; microphones; and the like. In various embodiments, user interface output devices include, but are not limited to: audio output devices such as speakers, headphones, earbuds, and the like; visual output devices such as lights, video displays and the like; and tactile devices such as rumble pads, hepatic touch screens, buttons, keys and the like. The user's interactions 408 are included by the interactive application 402 in application telemetry data 410 that is communicated by interactive controller 400 to various other components of a variable skill reward wagering system as described herein. The interactive application 402 receives application commands and resources 412 communicated from various other components of a variable skill reward wagering system as described herein. In some embodiments, the application telemetry data 410 may include user interactions with objects of the interactive application and a skill outcome for a skill proposition presented to the user by the interactive application 402.

In some embodiments, various components of the interactive application 402 can read data from an application state 414 in order to provide one or more features of the interactive application. In various embodiments, components of the interactive application 402 can include, but are not limited to: a physics engine; a rules engine; an audio engine; a graphics engine and the like. The physics engine is used to simulate physical interactions between virtual objects in the interactive application 402. The rules engine implements the rules of the interactive application and a random number generator that may be used for influencing or determining certain variables and/or outcomes to provide a randomizing influence on the operations of the interactive application. The graphics engine is used to generate a visual representation of the interactive application state to the user. The audio engine is used to generate an audio representation of the interactive application state to the user.

During operation, the interactive application reads and writes application resources 416 stored on a data store of the interactive controller host. The application resources 416 may include objects having graphics and/or control logic used to provide application environment objects of the interactive application. In various embodiments, the resources may also include, but are not limited to, video files that are used to generate a portion of the user presentation 406; audio files used to generate music, sound effects, etc. within the interactive application; configuration files used to configure the features of the interactive application; scripts or other types of control code used to provide various features of the interactive application; and graphics resources such as textures, objects, etc. that are used by a graphics engine to render objects displayed in an interactive application.

In operation, components of the interactive application 402 read portions of the application state 414 and generate the user presentation 406 for the user that is presented to the user using the user interface 404. The user perceives the user presentation and provides user interactions 408 using the user input devices. The corresponding user interactions are received as user actions or inputs by various components of the interactive application 402. The interactive application 402 translates the user actions into interactions with the virtual objects of the application environment stored in the application state 414. Components of the interactive application use the user interactions with the virtual objects of the interactive application and the interactive application state 414 to update the application state 414 and update the user presentation 406 presented to the user. The process loops continuously while the user interacts with the interactive application of the variable skill reward wagering system.

The interactive controller 400 provides one or more interfaces 418 between the interactive controller 400 and other components of a variable skill reward wagering system, such as, but not limited to, a process controller. The interactive controller 400 and the other variable skill reward wagering system components communicate with each other using the interface. The interface may be used to pass various types of data, and to communicate and receive messages, status data, commands and the like. In certain embodiments, the interactive controller 400 and a process controller communicate application commands and resources 412 and application telemetry data 410. In some embodiments, the communications include requests by the process controller that the interactive controller 400 update the application state 414 using data provided by the process controller.

In many embodiments, communications between a process controller and the interactive controller 400 includes a request that the interactive controller 400 update one or more resources 416 using data provided by the process controller. In a number of embodiments, the interactive controller 400 provides all or a portion of the application state to the process controller. In some embodiments, the interactive controller 400 may also provide data about one or more of the application resources 416 to the process controller. In some embodiments, the communication includes user interactions that the interactive controller 400 communicates to the process controller. The user interactions may be low level user interactions with the user interface 404, such as manipulation of an input device, or may be high level interactions with game objects as determined by the interactive application. The user interactions may also include resultant actions such as modifications to the application state 414 or game resources 416 resulting from the user's interactions taken in the variable skill reward wagering system interactive application. In some embodiments, user interactions include, but are not limited to, actions taken by entities such as non-user characters (NPC) of the interactive application that act on behalf of or under the control of the user.

In various embodiments, the application commands and resources 412 include skill proposition application commands and/or resources used by the interactive application to generate a presentation of a skill proposition presented to a user and to determine a skill outcome based on the user's skillful interaction with the presentation of the skill proposition.

In some embodiments, the interactive controller 400 includes a wagering user interface 420 used to provide variable skill reward wagering system telemetry data 422 to and from the user. The variable skill reward wagering system telemetry data 422 from the variable skill reward wagering system includes, but is not limited to, data used by the user to configure credit, application credit and interactive element wagers, and data about the chance-based wager proposition credits, application credits and interactive element wagers such as, but not limited to, credit, application credit and interactive element balances and credit, application credit and interactive element amounts wagered.

In some embodiments, the interactive controller includes one or more sensors (not shown). Such sensors may include, but are not limited to, physiological sensors that monitor the physiology of the user, environmental sensors that monitor the physical environment of the interactive controller, accelerometers that monitor changes in motion of the interactive controller, and location sensors that monitor the location of the interactive controller such as global positioning sensors (GPSs). The interactive controller 400 communicates sensor telemetry data to one or more components of the variable skill reward wagering system.

Figure 4B:
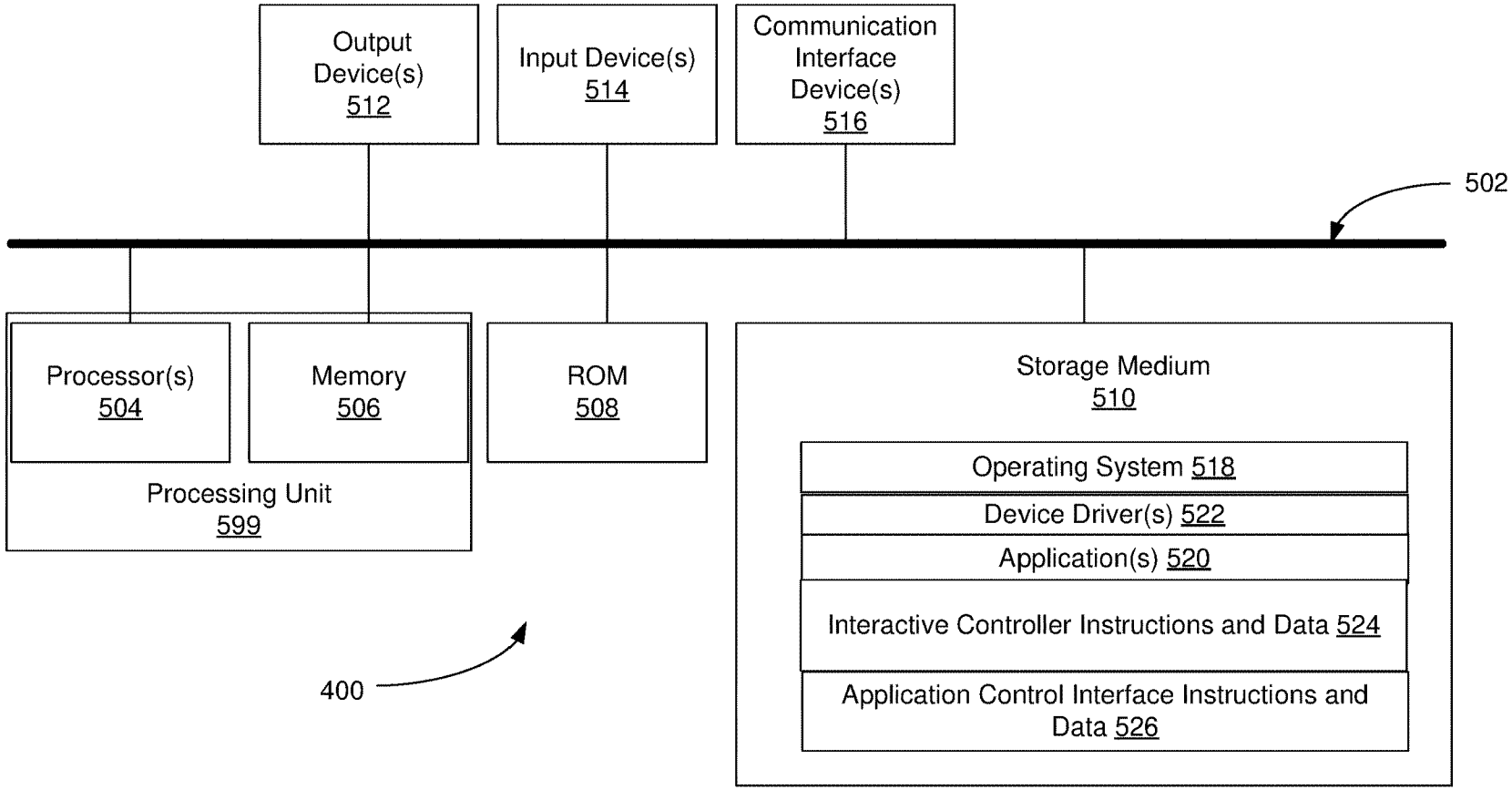

Referring now to FIG. 4B, interactive controller 400 includes a bus 502 that provides an interface for one or more processors 504, random access memory (RAM) 506, read only memory (ROM) 508, machine-readable storage medium 510, one or more user output devices 512, one or more user input devices 514, and one or more communication interface devices 516.

The one or more processors 504 may take many forms, such as, but not limited to: a central processing unit (CPU); a multi-processor unit (MPU); an ARM processor; a controller; a programmable logic device; or the like.

In the example embodiment, the one or more processors 504 and the random access memory (RAM) 506 form an interactive controller processing unit 599. In some embodiments, the interactive controller processing unit includes one or more processors operatively connected to one or more of a RAM, ROM, and machine-readable storage medium; the one or more processors of the interactive controller processing unit receive instructions stored by the one or more of a RAM, ROM, and machine-readable storage medium via a bus; and the one or more processors execute the received instructions. In some embodiments, the interactive controller processing unit is an ASIC (Application-Specific Integrated Circuit). In some embodiments, the interactive controller processing unit is a SoC (System-on-Chip).

Examples of output devices 512 include, but are not limited to, display screens; light panels; and/or lighted displays. In accordance with particular embodiments, the one or more processors 504 are operatively connected to audio output devices such as, but not limited to: speakers; and/or sound amplifiers. In accordance with many of these embodiments, the one or more processors 504 are operatively connected to tactile output devices like vibrators, and/or manipulators.

Examples of user input devices 514 include, but are not limited to: tactile devices including but not limited to, keyboards, keypads, foot pads, touch screens, and/or trackballs; non-contact devices such as audio input devices; motion sensors and motion capture devices that the interactive controller can use to receive inputs from a user when the user interacts with the interactive controller; physiological sensors that monitor the physiology of the user; environmental sensors that monitor the physical environment of the interactive controller; accelerometers that monitor changes in motion of the interactive controller; and location sensors that monitor the location of the interactive controller such as global positioning sensors.

The one or more communication interface devices 516 provide one or more wired or wireless interfaces for communicating data and commands between the interactive controller 400 and other devices that may be included in a variable skill reward wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS) interface, a cellular or satellite telephone network interface; and the like.

The machine-readable storage medium 510 stores machine-executable instructions for various components of the interactive controller, such as but not limited to: an operating system 518; one or more device drivers 522; one or more application programs 520 including but not limited to an interactive application; and variable skill reward wagering system interactive controller instructions and data 524 for use by the one or more processors 504 to provide the features of an interactive controller as described herein. In some embodiments, the machine-executable instructions further include application control interface/application control interface instructions and data 526 for use by the one or more processors 504 to provide the features of an application control interface/application control interface as described herein.

In various embodiments, the machine-readable storage medium 510 is one of a (or a combination of two or more of)

a hard drive, a flash drive, a DVD, a CD, a flash storage, a solid state drive, a ROM, an EIEPROM, and the like.

In operation, the machine-executable instructions are loaded into memory 506 from the machine-readable storage medium 510, the ROM 508 or any other storage location. The respective machine-executable instructions are accessed by the one or more processors 504 via the bus 502, and then executed by the one or more processors 504. Data used by the one or more processors 504 are also stored in memory 506, and the one or more processors 504 access such data during execution of the machine-executable instructions. Execution of the machine-executable instructions causes the one or more processors 504 to control the interactive controller 400 to provide the features of a variable skill reward wagering system interactive controller as described herein Although the interactive controller is described herein as being constructed from or configured using one or more processors and instructions stored and executed by hardware components, the interactive controller can be constructed from or configured using only hardware components in accordance with other embodiments. In addition, although the storage medium 510 is described as being operatively connected to the one or more processors through a bus, those skilled in the art of interactive controllers will understand that the storage medium can include removable media such as, but not limited to, a USB memory device, an optical CD ROM, magnetic media such as tape and disks. In some embodiments, the storage medium 510 can be accessed by the one or more processors 504 through one of the communication interface devices 516 or using a communication link. Furthermore, any of the user input devices or user output devices can be operatively connected to the one or more processors 504 via one of the communication interface devices 516 or using a communication link.

In some embodiments, the interactive controller 400 can be distributed across a plurality of different devices. In many such embodiments, an interactive controller of a variable skill reward wagering system includes an interactive application server operatively connected to an interactive client using a communication link. The interactive application server and interactive application client cooperate to provide the features of an interactive controller as described herein.

In various embodiments, the interactive controller 400 may be used to construct other components of a variable skill reward wagering system as described herein.

In some embodiments, components of an interactive controller and a process controller of a variable skill reward wagering system may be constructed from or configured using a single device using processes that communicate using an interprocess communication protocol. In other such embodiments, the components of an interactive controller and a process controller of a variable skill reward wagering system may communicate by passing messages, parameters or the like.

Figure 5:
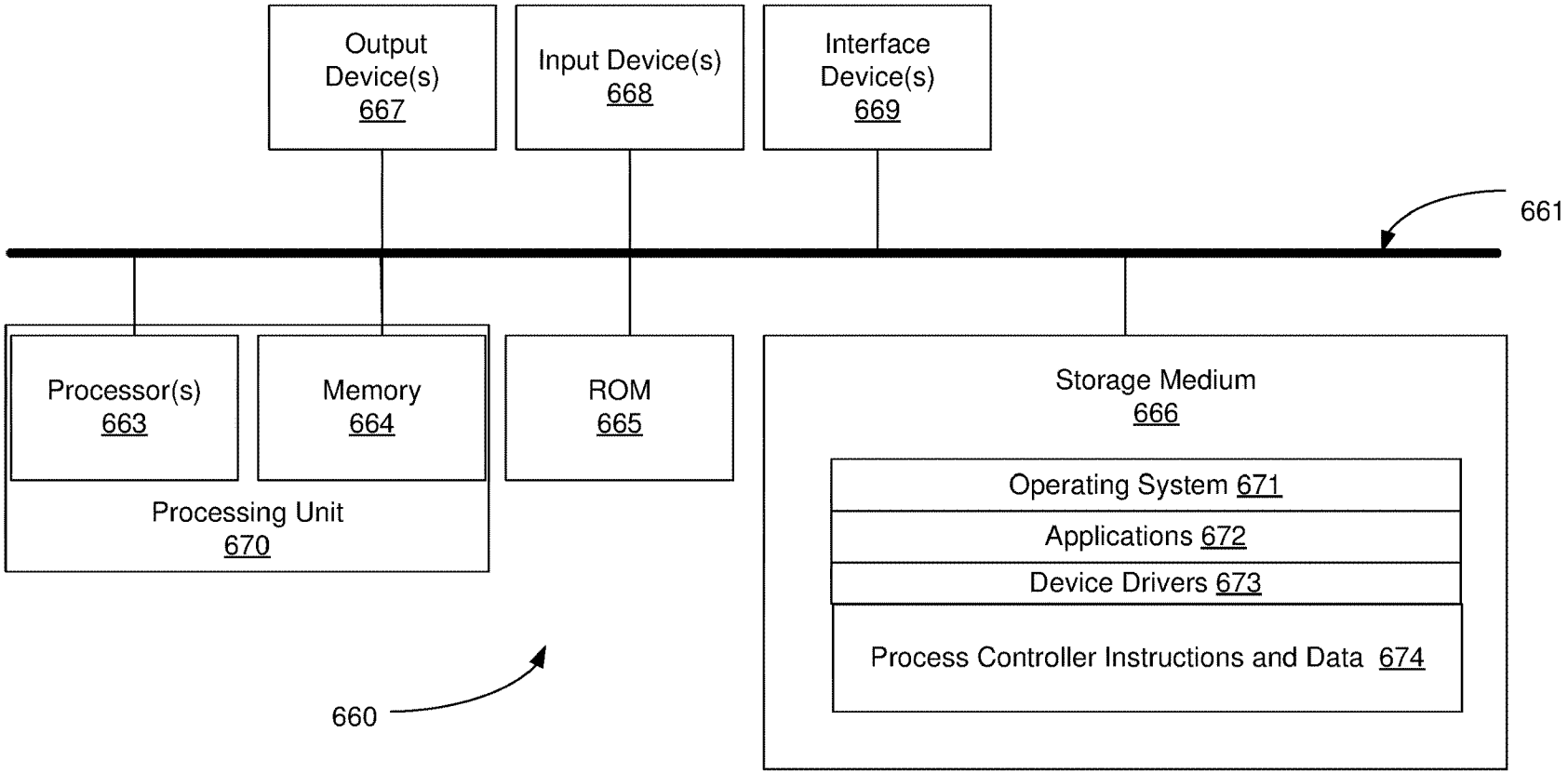
FIG. 5 is a diagram of a structure of a process controller of a variable skill reward wagering system in accordance with various embodiments of the invention.

FIG. 5 is a diagram of a structure of a process controller, suitable for use as process controller 104 of FIG. 1, of a variable skill reward wagering system in accordance with various embodiments of the invention. A process controller may be constructed from or configured using one or more processing devices that perform the operations of the process controller. In many embodiments, a process controller can be constructed from or configured using various types of processing devices including, but not limited to, a mobile device such as a smartphone, a personal digital assistant, a wireless device such as a tablet computer or the like, an electronic gaming machine such as a slot machine, a personal computer, a gaming console, a set-top box, a computing device, a controller, a server, or the like.

Process controller 660 includes a bus 661 providing an interface for one or more processors 663, random access memory (RAM) 664, read only memory (ROM) 665, machine-readable storage medium 666, one or more user output devices 667, one or more user input devices 668, and one or more communication interface and/or network interface devices 669.

The one or more processors 663 may take many forms, such as, but not limited to: a central processing unit (CPU); a multi-processor unit (MPU); an ARM processor; a programmable logic device; or the like.

Examples of output devices 667 include, include, but are not limited to: display screens; light panels; and/or lighted displays. In accordance with particular embodiments, the one or more processors 663 are operatively connected to audio output devices such as, but not limited to: speakers; and/or sound amplifiers. In accordance with many of these embodiments, the one or more processors 663 are operatively connected to tactile output devices like vibrators, and/or manipulators.

In the example embodiment, the one or more processors 663 and the random access memory (RAM) 664 form a process controller processing unit 670. In some embodiments, the process controller processing unit includes one or more processors operatively connected to one or more of a RAM, ROM, and machine-readable storage medium; the one or more processors of the process controller processing unit receive instructions stored by the one or more of a RAM, ROM, and machine-readable storage medium via a bus; and the one or more processors execute the received instructions. In some embodiments, the process controller processing unit is an ASIC (Application-Specific Integrated Circuit). In some embodiments, the process controller processing unit is a SoC (System-on-Chip).

Examples of user input devices 668 include, but are not limited to: tactile devices including but not limited to, keyboards, keypads, foot pads, touch screens, and/or trackballs; non-contact devices such as audio input devices; motion sensors and motion capture devices that the process controller can use to receive inputs from a user when the user interacts with the process controller 660.

The one or more communication interface and/or network interface devices 669 provide one or more wired or wireless interfaces for exchanging data and commands between the process controller 660 and other devices that may be included in a variable skill reward wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS), cellular, or satellite telephone network interface; and the like.

The machine-readable storage medium 666 stores machine-executable instructions for various components of the process controller 660 such as, but not limited to: an operating system 671; one or more applications 672; one or more device drivers 673; and variable skill reward wagering system process controller instructions and data 674 for use by the one or more processors 663 to provide the features of a process controller as described herein.

In various embodiments, the machine-readable storage medium 670 is one of a (or a combination of two or more of) a hard drive, a flash drive, a DVD, a CD, a flash storage, a solid state drive, a ROM, an EIEPROM, and the like.

In operation, the machine-executable instructions are loaded into memory 664 from the machine-readable storage medium 666, the ROM 665 or any other storage location. The respective machine-executable instructions are accessed by the one or more processors 663 via the bus 661, and then executed by the one or more processors 663. Data used by the one or more processors 663 are also stored in memory 664, and the one or more processors 663 access such data during execution of the machine-executable instructions. Execution of the machine-executable instructions causes the one or more processors 663 to control the process controller 660 to provide the features of a variable skill reward wagering system process controller as described herein.

Although the process controller 660 is described herein as being constructed from or configured using one or more processors and instructions stored and executed by hardware components, the process controller can be composed of only hardware components in accordance with other embodiments. In addition, although the storage medium 666 is described as being operatively connected to the one or more processors through a bus, those skilled in the art of process controllers will understand that the storage medium can include removable media such as, but not limited to, a USB memory device, an optical CD ROM, magnetic media such as tape and disks. Also, in some embodiments, the storage medium 666 may be accessed by processor 663 through one of the interfaces or using a communication link. Furthermore, any of the user input devices or user output devices may be operatively connected to the one or more processors 663 via one of the interfaces or using a communication link.

In various embodiments, the process controller 660 may be used to construct other components of a variable skill reward wagering system as described herein.

Figure 6:
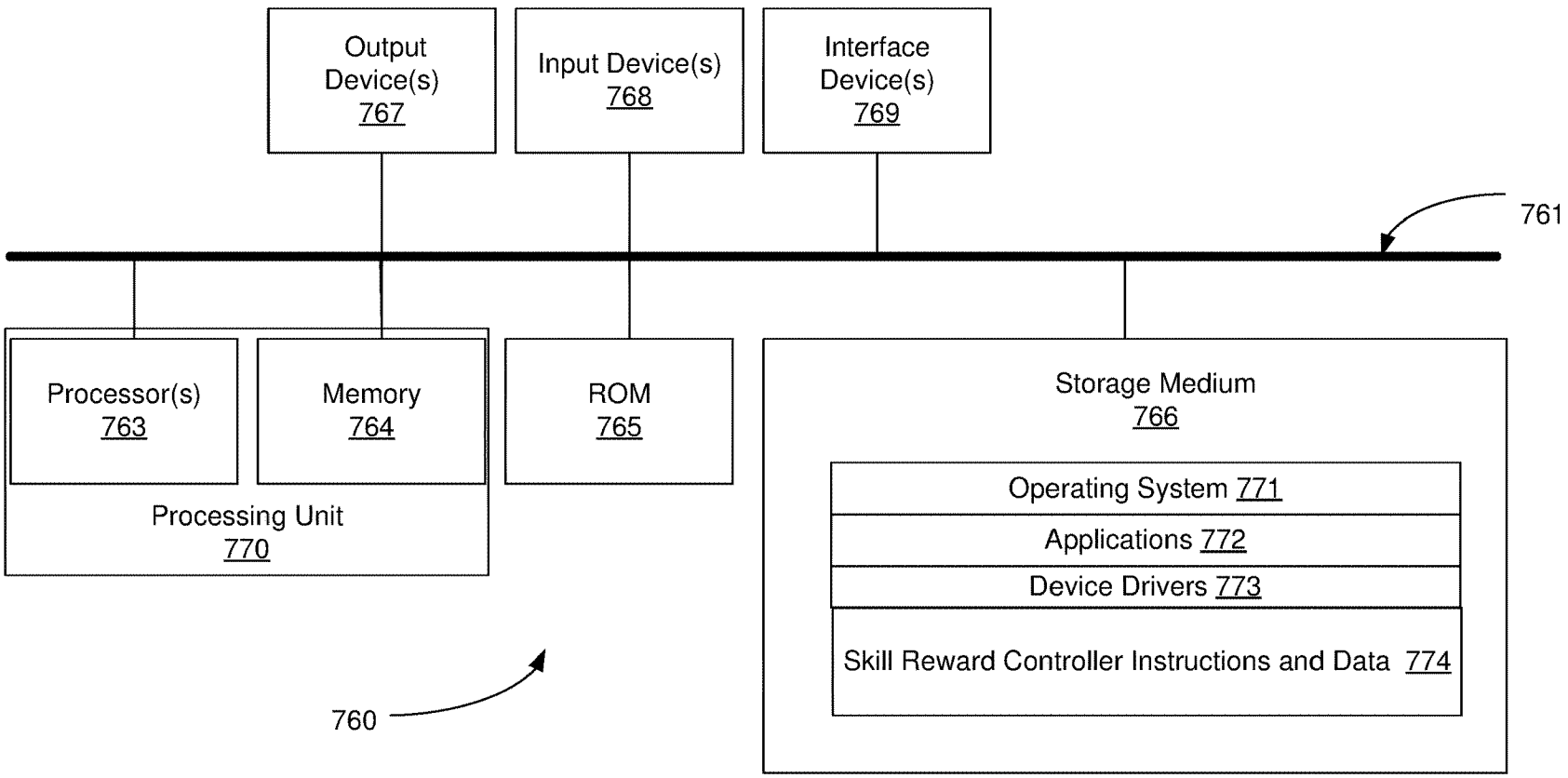
FIG. 6 is a diagram of a structure of a credit processing system of a variable skill reward wagering system in accordance with various embodiments of the invention.

FIG. 6 is a diagram of a structure of a variable skill reward controller, suitable for use as variable skill reward controller of FIG. 1, of a variable skill reward wagering system in accordance with various embodiments of the invention. A variable skill reward controller may be constructed from or configured using one or more processing devices that perform the operations of the variable skill reward controller. In many embodiments, a variable skill reward controller can be constructed from or configured using various types of processing devices including, but not limited to, a mobile device such as a smartphone, a personal digital assistant, a wireless device such as a tablet computer or the like, an electronic gaming machine such as a slot machine, a personal computer, a gaming console, a set-top box, a computing device, a controller, a server, or the like.

Variable skill reward controller 760 includes a bus 761 providing an interface for one or more processors 763, random access memory (RAM) 764, read only memory (ROM) 765, machine-readable storage medium 766, one or more user output devices 767, one or more user input devices 768, and one or more communication interface and/or network interface devices 769.

The one or more processors 763 may take many forms, such as, but not limited to: a central processing unit (CPU); a multi-processor unit (MPU); an ARM processor; a programmable logic device; or the like.

Examples of output devices 767 include, include, but are not limited to: display screens; light panels; and/or lighted displays. In accordance with particular embodiments, the one or more processors 763 are operatively connected to audio output devices such as, but not limited to: speakers; and/or sound amplifiers. In accordance with many of these embodiments, the one or more processors 763 are operatively connected to tactile output devices like vibrators, and/or manipulators.

In the example embodiment, the one or more processors 763 and the random access memory (RAM) 764 form a variable skill reward controller processing unit 770. In some embodiments, the variable skill reward controller processing unit includes one or more processors operatively connected to one or more of a RAM, ROM, and machine-readable storage medium; the one or more processors of the variable skill reward controller processing unit receive instructions stored by the one or more of a RAM, ROM, and machine-readable storage medium via a bus; and the one or more processors execute the received instructions. In some embodiments, the variable skill reward controller processing unit is an ASIC (Application-Specific Integrated Circuit). In some embodiments, the variable skill reward controller processing unit is a SoC (System-on-Chip).

Examples of user input devices 768 include, but are not limited to: tactile devices including but not limited to, keyboards, keypads, foot pads, touch screens, and/or trackballs; non-contact devices such as audio input devices; motion sensors and motion capture devices that the variable skill reward controller can use to receive inputs from a user when the user interacts with the variable skill reward controller 760.

The one or more communication interface and/or network interface devices 769 provide one or more wired or wireless interfaces for exchanging data and commands between the variable skill reward controller 760 and other devices that may be included in a variable skill reward wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS), cellular, or satellite telephone network interface; and the like.

The machine-readable storage medium 766 stores machine-executable instructions for various components of the variable skill reward controller 760 such as, but not limited to: an operating system 771; one or more applications 772; one or more device drivers 773; and variable skill reward controller instructions and data 774 for use by the one or more processors 763 to provide the features of a variable skill reward controller as described herein.

In various embodiments, the machine-readable storage medium 770 is one of a (or a combination of two or more of) a hard drive, a flash drive, a DVD, a CD, a flash storage, a solid state drive, a ROM, an EIEPROM, and the like.

In operation, the machine-executable instructions are loaded into memory 764 from the machine-readable storage medium 766, the ROM 765 or any other storage location. The respective machine-executable instructions are accessed by the one or more processors 763 via the bus 761, and then executed by the one or more processors 763. Data used by the one or more processors 763 are also stored in memory 764, and the one or more processors 763 access such data during execution of the machine-executable instructions. Execution of the machine-executable instructions causes the one or more processors 763 to control the variable skill reward controller 760 to provide the features of a variable skill reward wagering system variable skill reward controller as described herein.

Although the variable skill reward controller 760 is described herein as being constructed from or configured using one or more processors and instructions stored and executed by hardware components, the variable skill reward controller can be composed of only hardware components in accordance with other embodiments. In addition, although the storage medium 766 is described as being operatively connected to the one or more processors through a bus, those skilled in the art of variable skill reward controllers will understand that the storage medium can include removable media such as, but not limited to, a USB memory device, an optical CD ROM, magnetic media such as tape and disks. Also, in some embodiments, the storage medium 766 may be accessed by processor 763 through one of the interfaces or using a communication link. Furthermore, any of the user input devices or user output devices may be operatively connected to the one or more processors 763 via one of the interfaces or using a communication link.

In various embodiments, the variable skill reward controller 760 may be used to construct other components of a variable skill reward wagering system as described herein.

Figure 7:
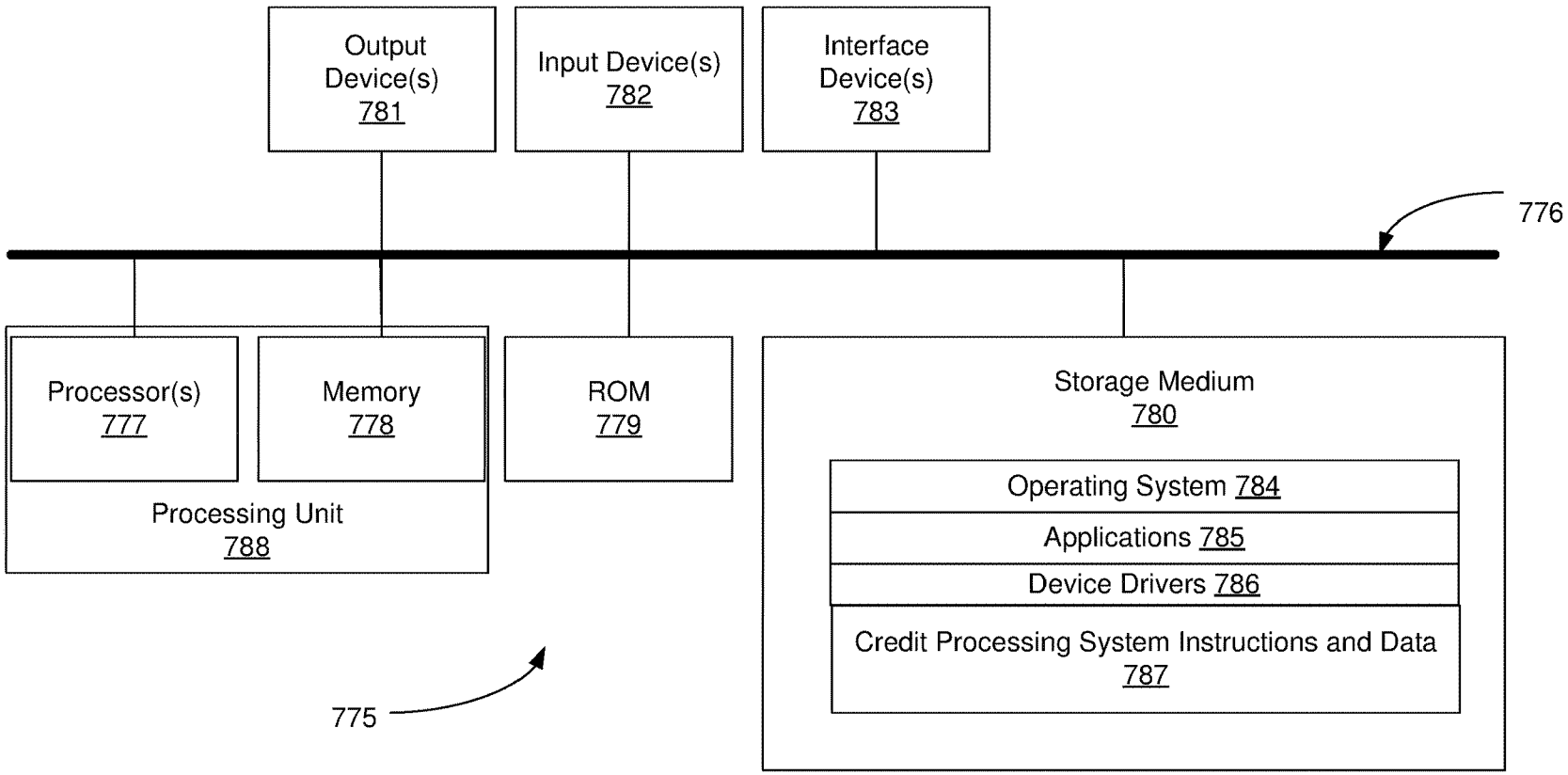
FIG. 7 is a diagram of a structure of a credit processing system in accordance with various embodiments of the invention.

FIG. 7 is a diagram of a structure of a credit processing system, suitable for use as credit processing system 105 of FIG. 1, of a variable skill reward wagering system in accordance with various embodiments of the invention. A credit processing system may be constructed from or configured using one or more processing devices that perform the operations of the credit processing system. In many embodiments, a credit processing system can be constructed from or configured using various types of processing devices including, but not limited to, a mobile device such as a smartphone, a personal digital assistant, a wireless device such as a tablet computer or the like, an electronic gaming machine such as a slot machine, a personal computer, a gaming console, a set-top box, a computing device, a controller, a server, or the like.

Credit processing system 775 includes a bus 776 providing an interface for one or more processors 777, random access memory (RAM) 778, read only memory (ROM) 779, machine-readable storage medium 780, one or more user output devices 781, one or more user input devices 782, and one or more communication interface and/or network interface devices 783.

The one or more processors may take many forms, such as, but not limited to: a central processing unit (CPU); a multi-processor unit (MPU); an ARM processor; a programmable logic device; or the like.

Examples of output devices include, but are not limited to: display screens; light panels; lighted displays; credit item printers and writing devices; audio output devices such as, but not limited to, buzzers, speakers and sound amplifiers; and tactile output devices like vibrators, and/or manipulators.

In the example embodiment, the one or more processors and the random access memory (RAM) form a credit processing system processing unit 788. In some embodiments, the credit processing system processing unit includes one or more processors operatively connected to one or more of a RAM, ROM, and machine-readable storage medium; the one or more processors of the credit processing system processing unit receive instructions stored by the one or more of a RAM, ROM, and machine-readable storage medium via a bus; and the one or more processors execute the received instructions. In some embodiments, the credit processing system processing unit is an ASIC (Application-Specific Integrated Circuit). In some embodiments, the credit processing system processing unit is a SoC (System-on-Chip).

Examples of user input devices include, but are not limited to: credit item reading devices such as optical and/or electromagnetic scanners; tactile devices including but not limited to, keyboards, keypads, foot pads, touch screens, and/or trackballs; non-contact devices such as audio input devices; motion sensors and motion capture devices that the credit processing system can use to receive inputs from a user when the user interacts with the credit processing system.

The one or more communication interface and/or network interface devices provide one or more wired or wireless interfaces for exchanging data and commands between the credit processing system and other devices that may be included in a variable skill reward wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS), cellular, or satellite telephone network interface; and the like.

The machine-readable storage medium stores machine-executable instructions for various components of the credit processing system such as, but not limited to: an operating system 784; one or more applications 785; one or more device drivers 786; and variable skill reward processing system instructions and data 787 for use by the one or more processors 763 to provide the features of a credit processing system as described herein.

In various embodiments, the machine-readable storage medium is one of a (or a combination of two or more of) a hard drive, a flash drive, a DVD, a CD, a flash storage, a solid state drive, a ROM, an EIEPROM, and the like.

In operation, the machine-executable instructions are loaded into memory from the machine-readable storage medium, the ROM or any other storage location. The respective machine-executable instructions are accessed by the one or more processors via the bus, and then executed by the one or more processors. Data used by the one or more processors are also stored in memory, and the one or more processors access such data during execution of the machine-executable instructions. Execution of the machine-executable instructions causes the one or more processors to control the credit processing system to provide the features of a credit processing system as described herein.

Although the credit processing system is described herein as being constructed from or configured using one or more processors and instructions stored and executed by hardware components, the credit processing system can be composed of only hardware components in accordance with other embodiments. In addition, although the storage medium is described as being operatively connected to the one or more processors through a bus, those skilled in the art of credit processing systems will understand that the storage medium can include removable media such as, but not limited to, a USB memory device, an optical CD ROM, magnetic media such as tape and disks. Also, in some embodiments, the storage medium may be accessed by the one or more processors through one of the interfaces or using a communication link. Furthermore, any of the user input devices or user output devices may be operatively connected to the one or more processors via one of the interfaces or using a communication link.

In various embodiments, the credit processing system may be used to construct other components of a variable skill reward wagering system as described herein.

Figure 8A:
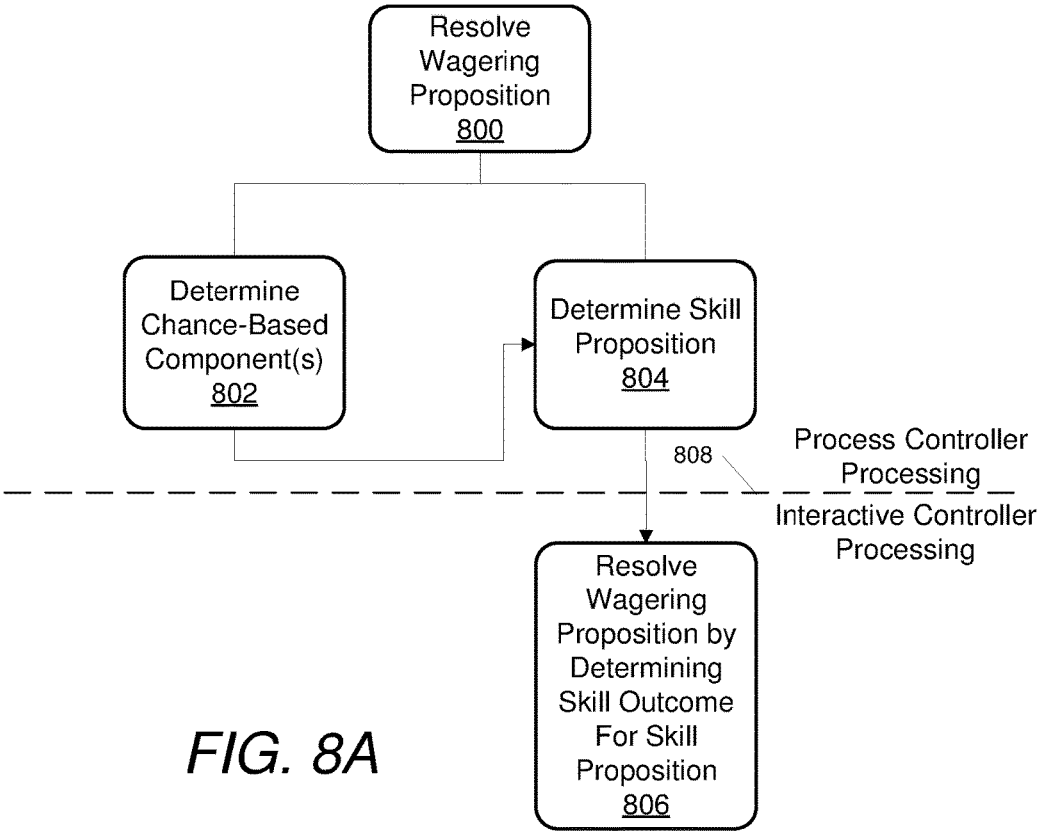
FIG. 8A is a block diagram of a process of a variable skill reward wagering system during a wagering session in accordance with various embodiments of the invention.

FIG. 8A is a block diagram of a process of a variable skill reward wagering system during a wagering session in accordance with various embodiments of the invention. A variable skill reward wagering system resolves 800 a wagering proposition by determining 802 a chance-based wager outcome using one or more random outcomes. The chance-based wager outcome is then used to determine 804 portions of a skill proposition that will be presented to one or more users. The wager is resolved 806 by determining a skill outcome for the skill proposition. The skill outcome includes one or more skill metrics. The one or more skill metrics may include, but are not limited to a number of skill-objectives achieved by the user and one or more separate skill metrics determined from the user's skillful play of a skill-based game.

In some embodiments, as indicated by dashed line 808, a process controller of the variable skill reward wagering system performs processing for determining 802 the chance-based wager outcome and determining 804 the skill proposition while an interactive controller performs processing for determining 806 the skill outcome.

Figure 8B:
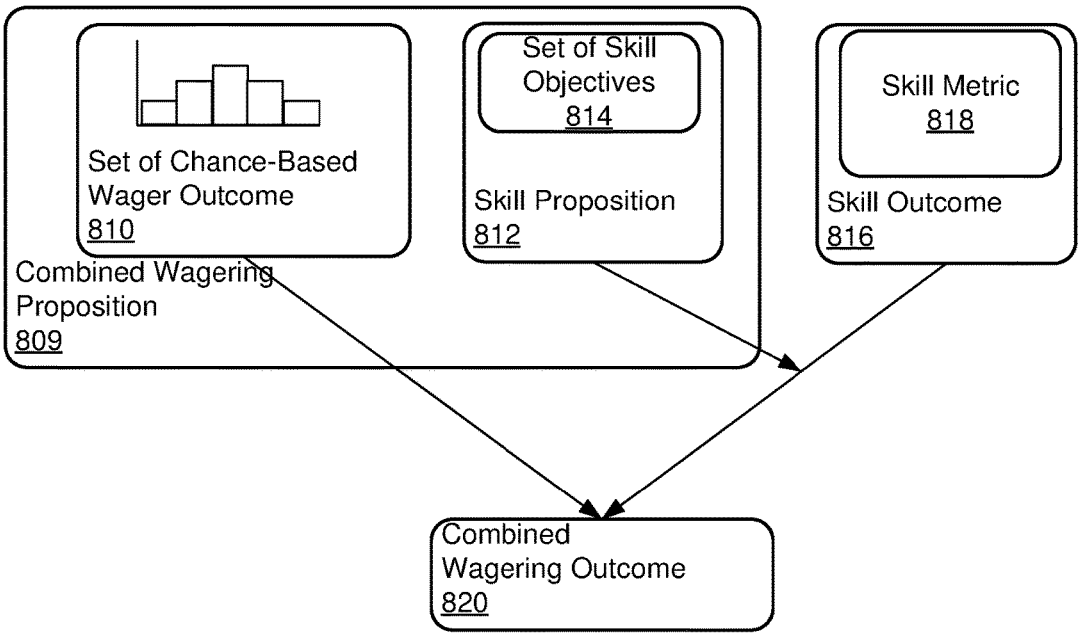
FIG. 8B is a block diagram of a combined wagering proposition of a variable skill reward wagering system during a wagering session in accordance with various embodiments of the invention.

FIG. 8B is a block diagram of a combined wagering proposition of a variable skill reward wagering system during a wagering session in accordance with various embodiments of the invention. A combined wagering proposition 809 includes a set of chance-based wager outcomes 810 and a skill proposition 812 having a set of skill objectives 814 that correspond to the set of chance-based wager outcomes 810.

During operation, a variable skill reward wagering system presents the skill proposition to a user as a set of skill objectives to be achieved by the user. Each member of the set of skill objectives is associated with a member of a set of chance-based wager outcomes. The variable skill reward wagering system determines a skill outcome 812 for the skill proposition including skill metric data describing the user's skill-based achievements achieved by the user 818 when presented with the skill proposition. A combined wagering outcome 820 is determined by combining the skill outcome 816 with the set of chance-based wager outcomes 810 to allocate the one or more of the chance-based wager outcomes to the user on the basis of the user achieving one or more of the skill objectives as determined from the skill metric data included in the skill outcome.

Figure 9:
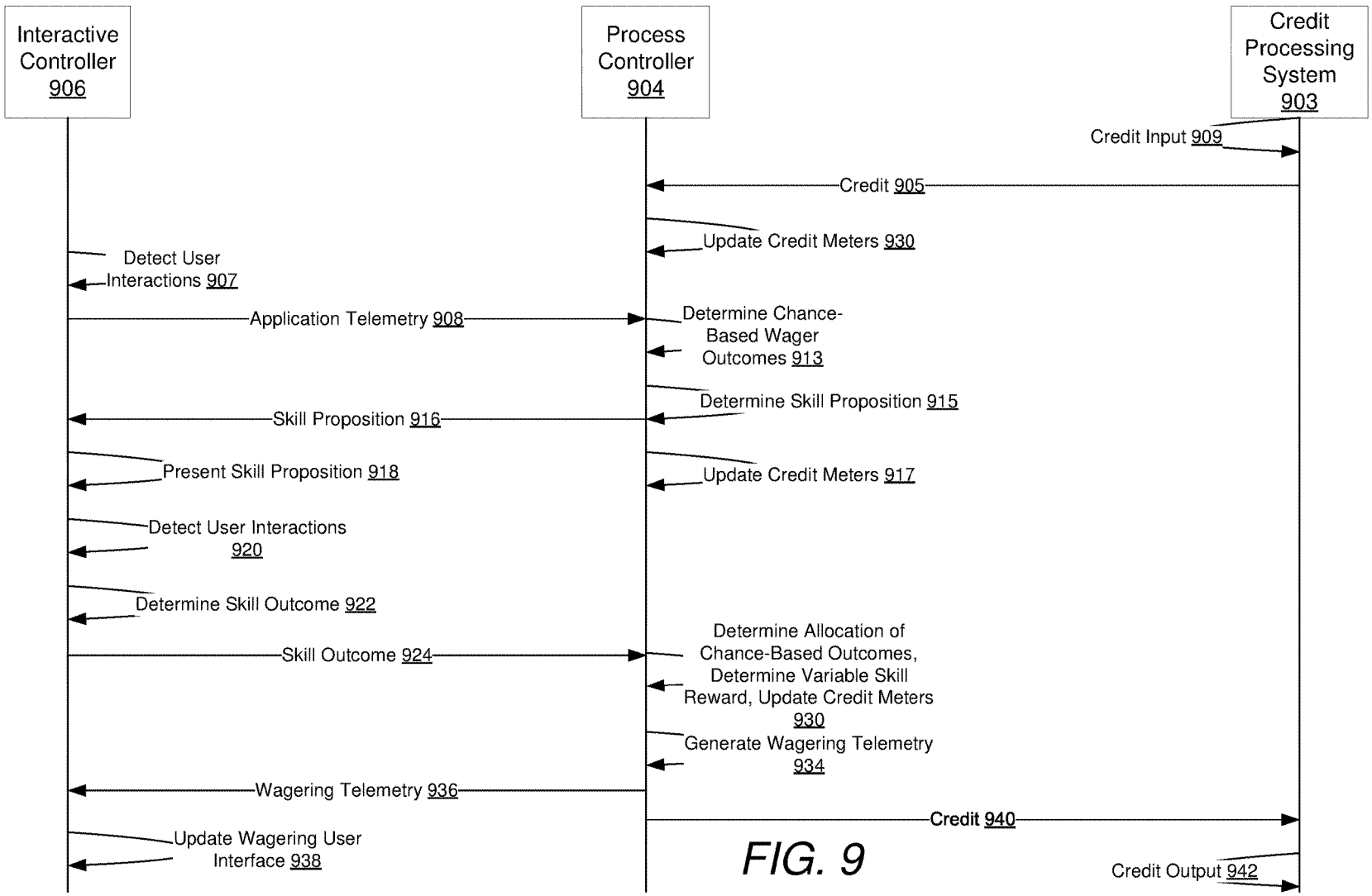
FIG. 9 is a sequence diagram of interactions between components of a variable skill reward wagering system during a wagering session in accordance with various embodiments of the invention.

FIG. 9 is a sequence diagram of interactions between components of a variable skill reward wagering system during a wagering session in accordance with various embodiments of the invention. The components of the variable skill reward wagering system include a process controller 904, such as process controller 104 of FIG. 1, an interactive controller 906, such as interactive controller 102 of FIG. 1, and a credit processing system 903, such as credit processing system 105 of FIG. 1.

In some embodiments, at a beginning of the wagering session, the process includes a credit input 909 to the variable skill reward wagering system with process controller 904 communicating with the credit processing system 903 to receive incoming credit data 905. The process controller 904 uses the incoming credit data to transfer credits onto one or more credit meter datastores associated with one or more users of the variable skill reward wagering system, thus transferring credits into the variable skill reward wagering system and on to the one or more credit meter datastores.

In many embodiments, the interactive controller 906 detects 907 one or more users performing a user interaction in an application interface of an interactive application provided by the interactive controller 906. The interactive controller 906 communicates application telemetry data 908 to the process controller 904. The application telemetry data 908 includes, but is not limited to, the user interaction detected by the interactive controller 906.

The process controller 904 receives the application telemetry data 908. Upon determination by the process controller 904 that the user interaction indicates a wagering event in accordance with a combined wagering proposition, the process controller 904 determines 913 one or more chance-based wager outcomes of the combined wagering proposition and uses the chance-based wager outcome to determine 915 a skill proposition of the combined wagering proposition. The process controller 904 communicates data of the skill proposition 916 to the interactive controller 906. The process controller 904 updates 917 one or more credit meter datastores associated with the one or more users based on amounts of credits wagered in the wagering event.

The interactive controller 906 receives the skill proposition data 916 from the process controller 904 and uses the skill proposition data 916 to generate and present 918 to the one or more users a skill proposition. The presentation of the skill proposition is presented to the one or more users in the user interface of the interactive application of the interactive controller 906. The interactive controller 906 detects 920 user interactions of the one or more users with the presentation of the skill proposition and determines 922 a skill outcome based on the detected user interactions and the skill proposition data 916. The interactive controller 906 communicates data of the skill outcome 924 to the process controller 904.

The process controller 904 receives the skill outcome data 924. The process controller uses the skill outcome data and the chance-based wager outcome data to determine 930 a combined wagering outcome by allocating the chance-based wager outcomes to the user using the skill outcome data, and to determine a variable skill reward for the user based on one or more skill metrics included in the skill outcome data, and updates 930 the one or more credit meter datastores associated with the one or more users based on the combined wagering outcome and the variable skill reward. The process controller 904 generates 934 wagering telemetry data 936 using data of the combined wagering outcome, data of the variable skill award, and data of the updated one or more credit meter datastores. The process controller 904 communicates the wagering telemetry data 936 to the interactive controller 906.

In some embodiments, the process controller uses a variable skill reward controller, such as variable skill reward controller 162 of FIG. 1, to determine the variable skill reward.

The interactive controller 906 receives the wagering telemetry data 936. The interactive controller 906 updates 938 a wagering user interface on a partial basis of the wagering telemetry data 936.

In many embodiments, upon determining that the wagering session is completed, such as by receiving a cashout communication from one or more users of the variable skill reward wagering system, the process controller 904 transfers credits off of the one or more credit meter datastores, generates outgoing credit data 940 on the basis of the credits transferred off of the one or more credit meter datastores, and communicates the outgoing credit data 940 to the credit processing system 903. The credit processing system receives the outgoing credit data 940 and generates 942 a credit output as described herein, thus transferring credits off of the one or more credit meter datastores and out of the variable skill reward wagering system.

In some embodiments, at a beginning of the wagering session, the process includes an application credit input to the variable skill reward wagering system with the process controller 904 communicating with the credit processing system 903 to receive incoming application credit data. The process controller 902 uses the incoming application credit data to transfer application credits onto one or more application credit meter datastores associated with one or more users of the variable skill reward wagering system, thus transferring application credits into the variable skill reward wagering system and on to the one or more application credit meter datastores. The process controller 904 uses the skill outcome data 924 to determine an amount of application credit to award to a user based on the user's skillful interactions with an interactive application executed by the interactive controller 905. Upon determining that the wagering session is completed, such as by receiving a cashout communication from one or more users of the variable skill reward wagering system, the process controller 904 transfers application credits off of the one or more application credit meter datastores, generates outgoing application credit data on the basis of the application credits transferred off of the one or more application credit meter datastores, and communicates the outgoing application credit data to the credit processing system 903. The credit processing system receives the outgoing application credit data and generates an application credit output as described herein, thus transferring application credits off of the one or more application credit meter datastores and out of the variable skill reward wagering system.

In some embodiments, a variable skill reward wagering system has a variable skill reward pool. In many such embodiments, the wagering subcontroller allocates a portion of a wager or a chance-based wager outcome to a variable skill reward pool credit meter datastore. The wagering subcontroller may take credits from the variable skill reward pool as an outcome of a combined wagering proposition.

In some embodiments, the process controller determines what resources and commands to provide to the interactive controller for use by the interactive application provided by the interactive controller partially on the basis of the chance-based wager outcome. In some such embodiments, resources are provided in a case that the wager was a winning wager for the user. In other such embodiments, fewer or no resources are provided in a case of a losing wager.

In some embodiments, the process controller determines what resources to provide based on internal logic of the process controller. In some such embodiments, the process controller employs a random outcome generator, such as a random number generator, to generate a random outcome and the random outcome is used to determine what resources are provided to the interactive controller.

In several embodiments, the process controller determines an increment or a decrement of an amount of AC using the interactions received from the interactive controller. The increment or decremented amount is communicated to the interactive controller for display to the user.

In some embodiments, the process controller executes a wager of Cr as a virtual currency, AC, interactive elements or objects. In some such embodiments, the process controller employs a random outcome generator, such as a random number generator, to generate a random outcome and the random outcome is used to determine a chance-based wager outcome in Cr as a virtual currency, AC, interactive elements or objects.

In many embodiments, a session/management controller of a variable skill reward wagering system is used to store AC for use of the user. In such an embodiment, AC is generated by the process controller based on the user's use of the variable skill reward wagering system and an amount of the AC is communicated to the session/management controller. The session/management controller stores the amount of AC between sessions. In some embodiments, the session/management controller communicates an amount of AC to the process controller at the start of a session for use by the user during a session.

Figure 10:
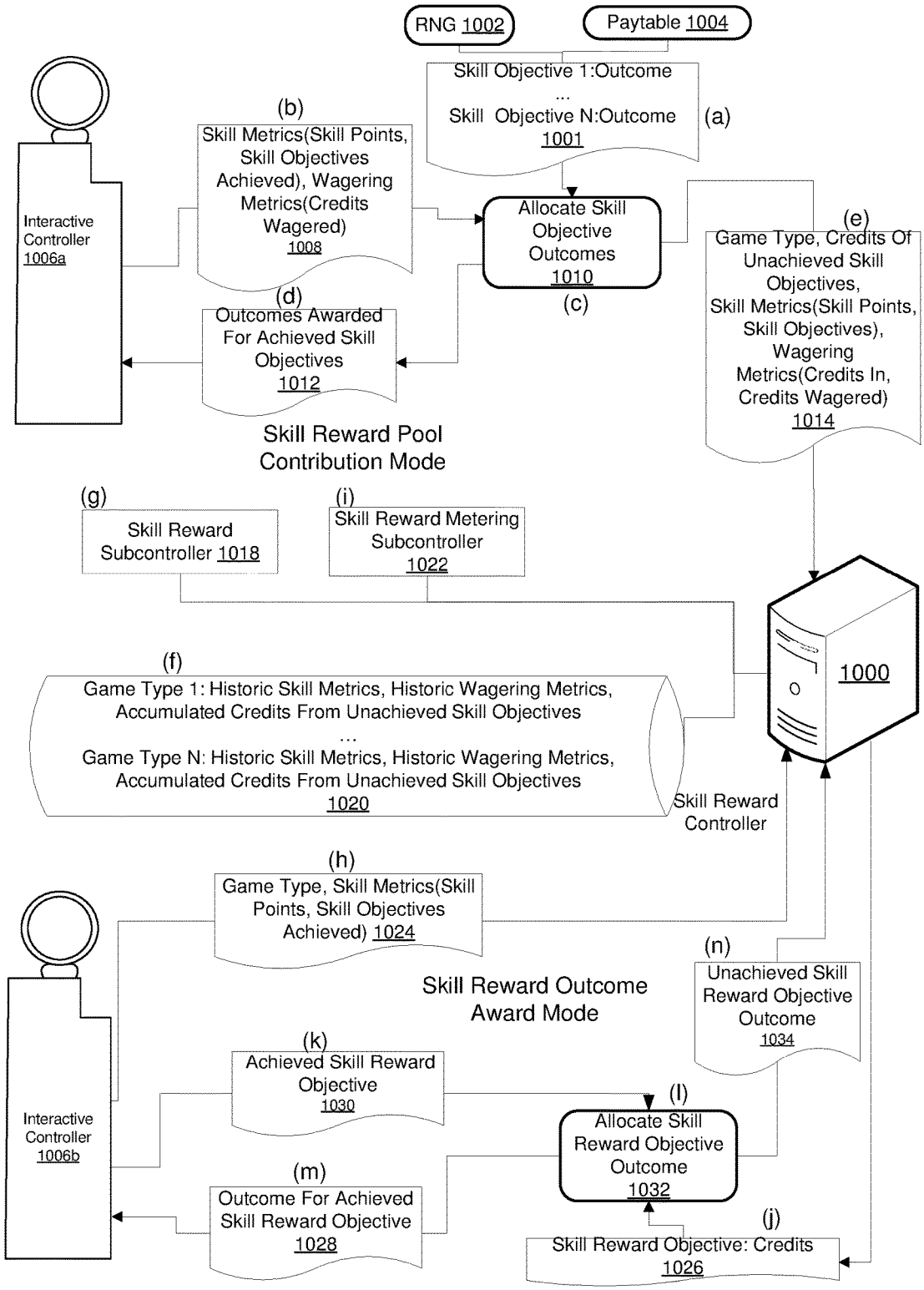
FIG. 10 is a collaboration diagram illustrating interoperation of components of a variable skill reward wagering system in accordance with various embodiments of the invention.

FIG. 10 is a collaboration diagram illustrating interoperation of components of a variable skill reward wagering system in accordance with various embodiments of the invention. In a variable skill reward pool contribution mode, a process controller 1000 generates (a) a range of skill objectives 1001 associated with chance based-components. The chance-based wager outcomes are determined by the process controller using a random number generator 1001 and a paytable 1004 as described herein. In many embodiments, the chance-based wager outcomes are credit amounts determined during wagers made using credits committed by a user.

The user plays a skill-based game provided by an interactive application executing on one or more interactive controllers, such as interactive controllers 1006*a* and 1006*b*, to achieve the skill objectives. The interactive application determines, from the user's skillful play and wagering, skill metrics and wagering metrics 1008. The skill metrics include skill objectives achieved by the user during skillful play of the skill-based game provided by the interactive application. In some embodiments, the skill metrics further include application credits or skill points as determined by the user's skillful play. The interactive controller communicates (b) data of the skill metrics to the process controller as application telemetry data. The process controller also determines wagering metrics of the user's skillful play from a wagering subcontroller during the user's skillful play of the interactive application. The wagering metrics include wagers of amounts of credits wagered by the user. In some embodiments, the wager metrics further include amounts of credits awarded to the user.

The process controller allocates 1010 (*c*) chance-based wager outcomes associated with the skill objectives based on the skill metrics. In some embodiments, if the user does not achieve all of the skill objectives, the user will not receive all of the chance-based wager outcomes associated with the skill objectives.

The user is awarded 1012 (*d*) the credits of the chance-based wager outcomes associated with the achieved skill objectives. The process controller transfers (e) the credits of the unachieved skill objective credits, along with communicating data of the skill metrics, data of the wagering metrics and data of a game type ID 1014, to the variable skill reward controller 1018.

The variable skill reward controller keeps (f) a datastore, such as database 1020 of skill metrics, wagering metrics and contributed credits for each game type. The contributed credits are stored in one or more skill reward pool credit meter datastores 1022.

In a variable skill reward outcome award mode, to award a variable skill reward for a user's skill achievements, a process controller 1000 coupled to the interactive controller 1006*b*, sends a request (h), for a variable skill reward outcome to the variable skill reward controller. The request 1024 for a variable skill reward outcome includes skill metrics for the user In some embodiments, the request for a variable skill reward outcome includes a game type ID so that variable skill rewards can be allocated in accordance with game types for two or more game types being provided to users on the one more interactive controllers. The variable skill reward controller 1018 uses one or more variable skill reward outcome allocation rules to determine (j) a variable skill reward outcome in credits 1026 for the game type. Data of the variable skill reward outcome is communicated by the variable skill reward controller to the process controller. The variable skill reward outcome is awarded 1028 (*m*) to the user.

In some embodiments, the process controller determines a variable skill reward objective and associates the variable skill reward objective with the variable skill reward outcome.

The user plays the skill-based game attempting to achieve the variable skill reward objective. The interactive application determines 1030 (*k*) if the user has achieved the variable skill reward objective. The interactive application communicates data of the achieved variable skill reward objective to the process controller as application telemetry data. The process controller uses the data of the achieved variable skill reward objective to allocate 1032 (*l*) the skill outcome to the user if the user achieves the variable skill reward objective. If the user does not achieve the variable skill reward objective, the process controller transfers 1034 (*n*) the outcome of the unachieved variable skill reward objective back to the variable skill reward controller.

FIG. 11 illustrates is a table, namely Table 1, including rules for a variable skill reward wagering system in accordance with an embodiment of the invention. In an example embodiment, a rule has the following syntax and meaning:
"If Individual_Skill_Metric>Average_Skill_Metric(Game_Type) then Skill_Variable skill reward=Accumulated_Unacheived_Skill_Objective_Credits(Game_Type)×0.5"
In other words, if an individual user's performance is greater than the average skill performance for all users playing the same game, then that individual user will be given the opportunity to win, through skillful play, one half of all credits in the variable skill reward pool contributed to the variable skill reward pool for that game type.

In another example embodiment, a rule has the following syntax and meaning:
"If (Individual_Skill_Metric>Average_Skill_Metric(Game_Type)) AND (RTP(Game_Type)<Target_RTP(Game_Type) then Skill_Variable skill reward=Accumulated_Unacheived_Skill_Objective_Credits(Game_Type)×0.75."
In other words, if an individual user's performance is greater than the average skill performance for all users playing the same game AND the return to users of that game is less than a target return to players (RTP) for that game, then that individual user will be given the opportunity to win through skillful play, three quarters of all credits in the variable skill reward pool contributed for that game.

Figure 12:
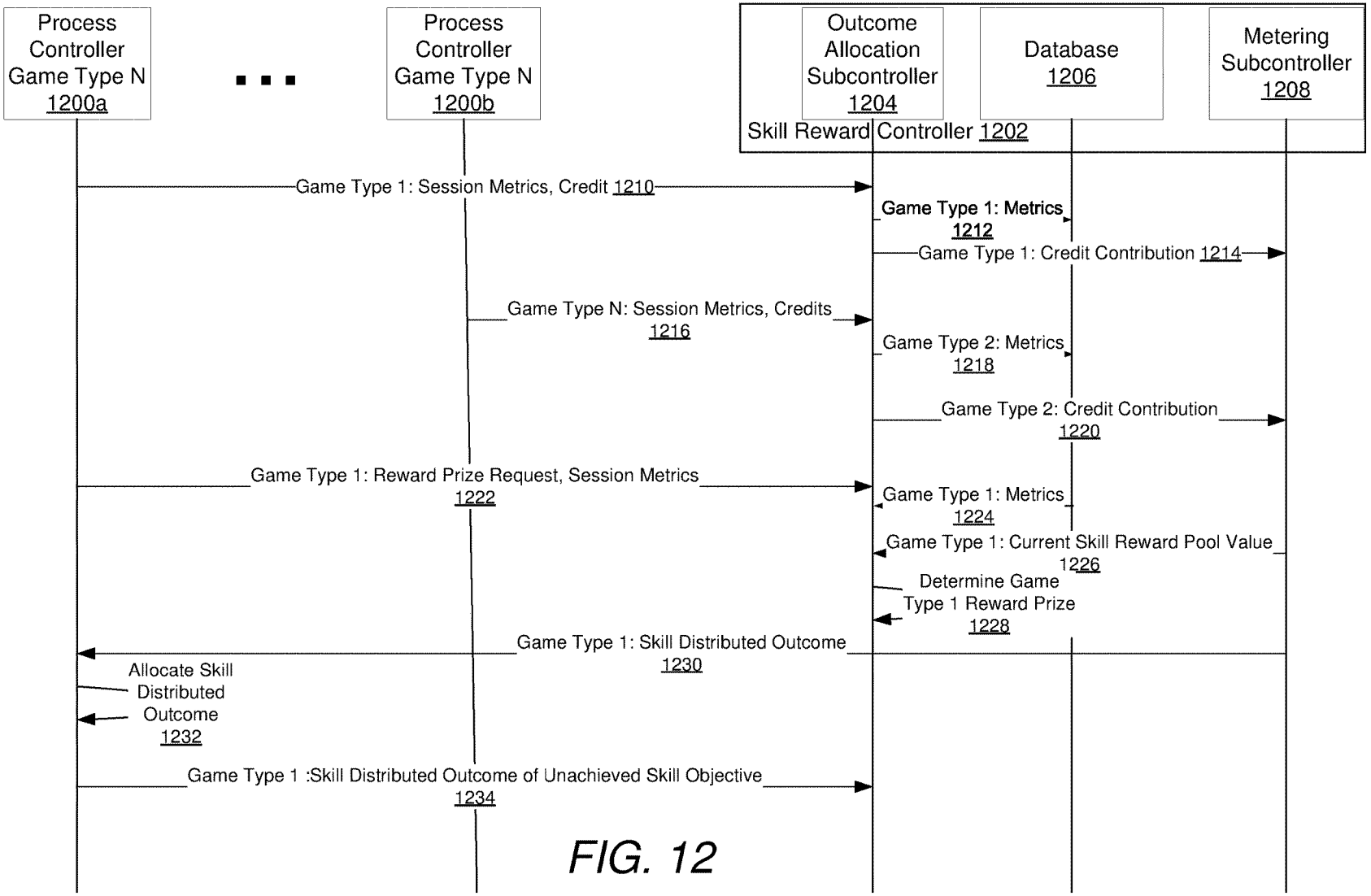
FIG. 12 is a sequence diagram of a process of a variable skill reward wagering system in accordance with various embodiments of the invention.

FIG. 12 is a sequence diagram of a process of a variable skill reward wagering system in accordance with various embodiments of the invention. One or more process controllers, such as process controllers 1200*a* and 1200*b*, provide support to one or more interactive controllers executing interactive applications that provide one or more skill-based game types. Each skill-based game type is identified by a unique game type identifier. During a session, a process controller provides chance-based wager outcomes for skill objectives for a skill-based game provided by an interactive application executing on an interactive controller (not shown) as described herein. The process controller communicates, 1210 and 1216, data of session metrics and credits associated with chance-based outcomes of unachieved skill objectives to a variable skill reward controller 1202 as described herein. In many embodiments, the communication also includes data of a game type identifier. In some embodiments, the session metrics include, but are not limited to, credits wagered, credits awarded, skill objectives achieved, unachieved skill objective credits and skill points earned. The variable skill reward controller receives the game type, session metrics and the chance-based outcomes of the unachieved skill objectives from the process controller. The variable skill reward controller stores, 1212 and 1218, data of the session metrics in a datastore such as database 1206 associated with the game type. In addition, the variable skill reward controller stores, 1214 and 1220, data of the chance-based wager outcomes of unachieved skill objectives in a credit meter datastore of a metering subcontroller 1208. In various embodiments, the session metrics stored in the datastore further include the data of the chance-based wager outcomes of the unachieved skill objectives.

In some embodiments, separate credit meter datastores are maintained for each game type supported by the variable skill reward controller.

When a process controller determines that a variable skill reward should be provided to a user, the process controller communicates 1222 a request to the variable skill reward controller. The request may include data of an identifier of a game type and current session skill and wagering metrics. The variable skill reward controller receives the request and uses the game type to determine 1224 historic session metric data from the datastore associated with the game type. The variable skill reward controller also retrieves 1226 a current skill reward pool value from the metering subcontroller 1208. The variable skill reward controller uses the data of the current skill reward pool value, data of the retrieved historic session metrics, and the data of the current session metrics to determine 1228 a variable skill reward. The variable skill reward controller transfers 1230 credits from the skill credit meter datastores as the variable skill reward and communicates data of the variable skill reward to the process controller. The process controller determines one or more skill objectives and associates the variable skill reward to the one or more skill objectives to generate one or more skill objectives. The process controller provides the one or more skill objectives to the interactive application of the interactive controller (not shown) for presentation to the user. The user uses the interactive application and attempts to achieve the one or more skill objectives. The interactive application of the interactive controller communicates data of the achieved one or more skill objectives to the process controller. The process controller receives the data of the achieved skill objective to the process controller and allocates 1232 the variable skill reward to the user if the user has achieved one or more of the one or more skill objectives. If the user has not achieved on or more of the one or more skill objectives the process controller transfers 1234 credits of the variable skill reward back the variable skill reward controller.

Figure 13:
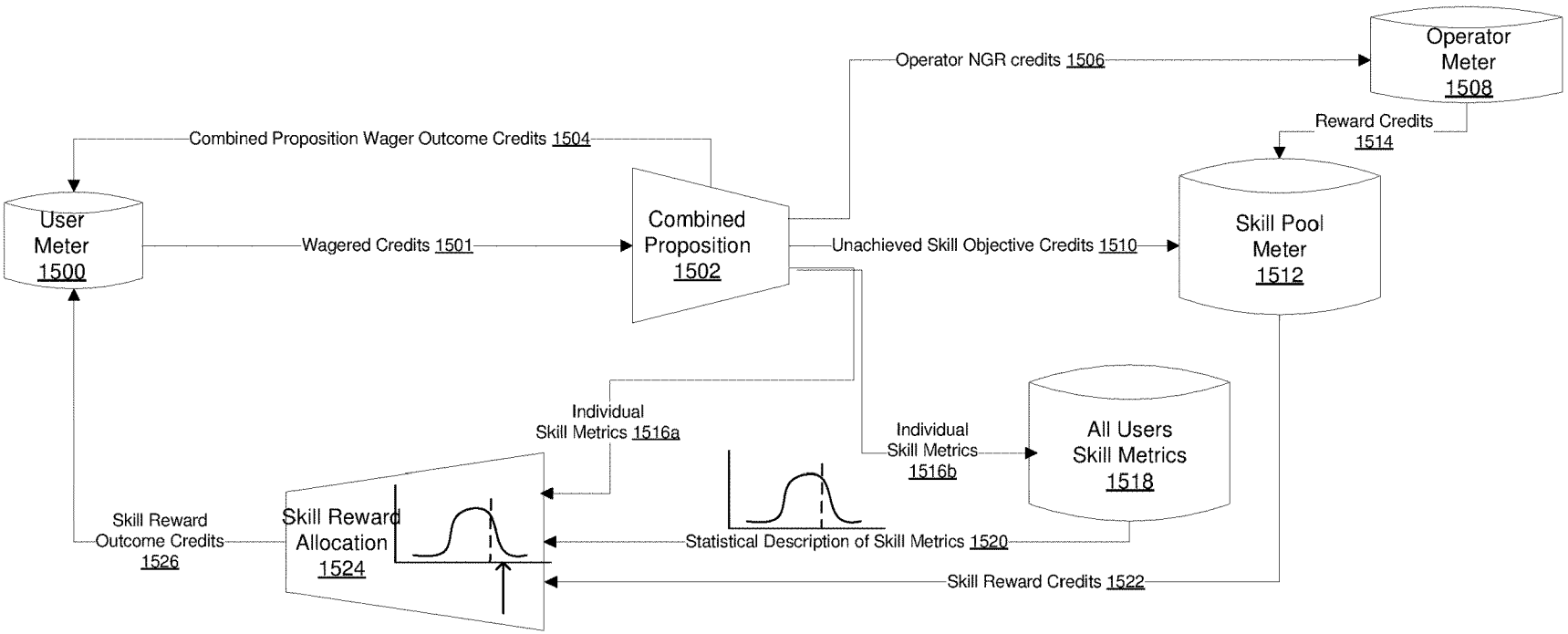
FIG. 13 is a process flow diagram of a crediting process in a variable skill reward wagering system in accordance with various embodiments of the invention.

FIG. 13 is a process flow diagram of a crediting process performed by a variable skill reward wagering system in accordance with various embodiments of the invention. A user credit meter datastore 1500 is used to store credits for use by a user. An amount of credits 1501 from the credit meter datastore of the user are wagered in a combined wagering proposition 1502 as described herein. One output of the combined wagering proposition is an amount of credits that are transferred to the user credit meter datastore as a combined wagering proposition outcome 1504. The amount of credits transferred is based on a set of chance-based wager outcomes and a number of skill objectives of the combined wagering proposition achieved by the user as described herein. Another output of the combined wagering proposition is an amount of net gaming revenue credits 1506 that are allocated to an operator of the variable skill reward wagering system and stored in an operator credit meter datastore 1508. Another output of the combined wagering proposition is an amount of credits associated with unachieved skill objectives 1510 as described herein, that are transferred to a variable skill reward pool credit meter datastore 1512. Another output of the combined wagering proposition are individual skill metrics, 1516*a* and 1516*b*, of the user as the user attempts to achieve the skill objectives that are stored in a user skill metric datastore such as database 1518 along with skill metrics of one or more other users.

In some embodiments, a portion of the amount of credits included in the combined wagering proposition credits awarded to the user for achieving skill objectives is transferred to the variable skill reward pool credit meter datastore.

In some embodiments, a portion of the amount of credits transferred to the operator's credit meter datastore is transferred 1514 to the variable skill reward pool credit meter datastore as promotional credits taken from the operator's marketing budget for one or more games.

In some embodiments, individual skill metrics include two or more types of skill metrics, with at least one skill metric being a coarse skill metric, such as but not limited to, a number of skill objectives achieved by the user; and at least one fine skill metric, such as a skill score determined from the user's proficiency at a skill-based game that forms the basis for the skill objectives. In an example embodiment, the skill-based game is a pinball game wherein a user receives skill points for striking toys within the pinball game (the fine skill metric) while the user attempts to achieve a small set of skill objectives (the coarse skill metric).

To determine a variable skill reward for the user, a variable skill reward allocation subcontroller receives an input of the individual skill metrics for a user and an input of a statistical description of skill metrics collected from at least one other user of the variable skill reward wagering system. The variable skill reward allocation subcontroller compares 1524 the user's individual skill metrics against the statistical description of the skill metrics of the at least one other user. If the user's skill metrics indicate that the user has achieved a skill proficiency at or above a specified threshold as compared to the at least one other user, then the variable skill reward allocation subcontroller transfers an amount of credits from the variable skill reward pool credit meter datastore as variable skill reward credits 1526 to the user's credit meter datastore as variable skill reward credits.

In an example embodiment, the statistical description of skill metrics is a ranking of a plurality of users of fine skill metrics for a plurality of users. A user is awarded a variable skill reward if the user's individual skill metrics indicate that the user has achieved a skill proficiency placing the user at or above a specified percentile of all users.

In another example embodiment, the statistical description of skill metrics includes a mean value of a skill metric of a plurality of users and a standard deviation of the skill metric for the plurality of users. The user is awarded a variable skill reward if the user's individual skill metric is above the mean of all the other user's skill metric by a specified multiplier of the standard deviation.

In another example embodiment, a user is awarded a skill outcome if the sum of the user's achieved skill credits is less than an amount of credits wagered. That is, if the sum of the credit values of the chance-based wager outcomes determined by a random number generator and a paytable and associated with skill objective achievements achieved by the user is at least equal to the value of the credits wagered by the user, the user is not awarded additional skill credits.

Figure 14:
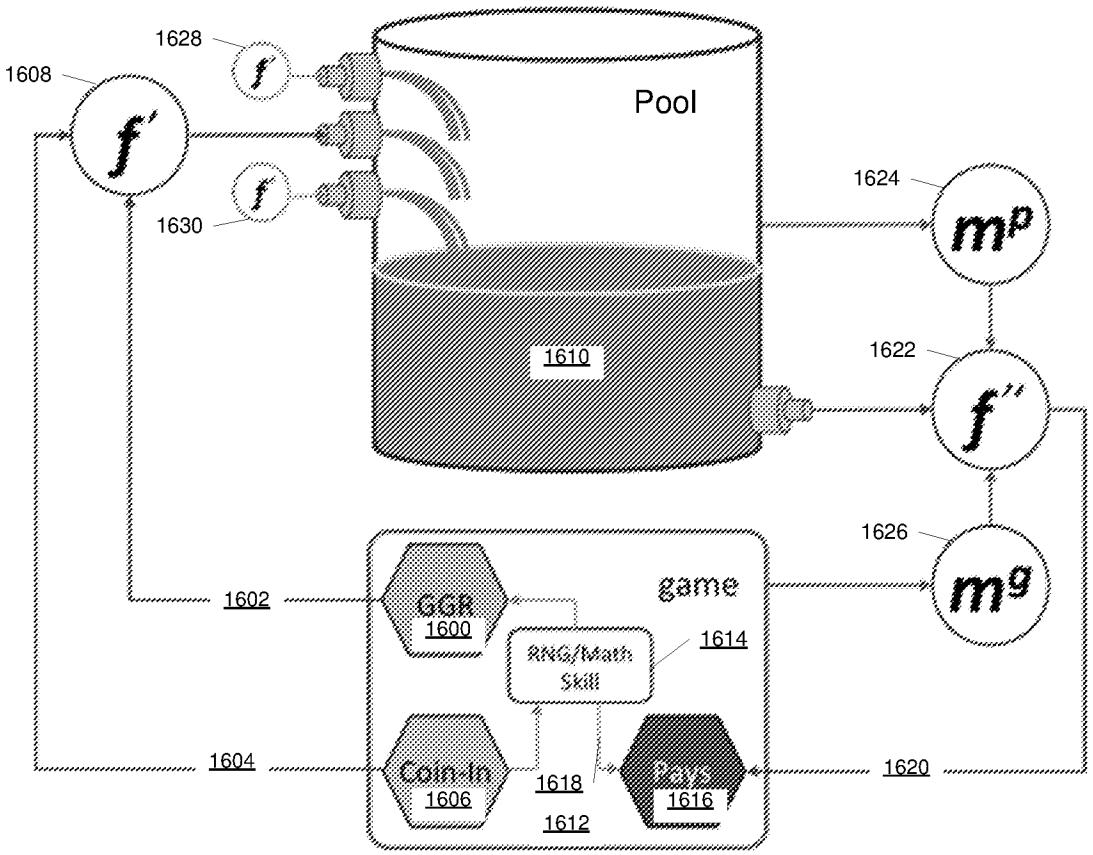
FIG. 14 is another process flow diagram of a crediting process in a variable skill reward wagering system in accordance with various embodiments of the invention.

FIG. 14 is a process flow diagram of another crediting process in a variable skill reward wagering system in accordance with various embodiments of the invention. A skill reward controller of the variable skill reward wagering system receives credit wagering data including but not limited to credit amount data 1602 of credits that are attributed to gross gaming revenues (GGR) 1600, and credit amount data 1604 of credits that are attributed to credits committed to a wagering proposition by a user (Coin In) 1606. The credit wagering data are used to determine an amount of credits to be added to a progressive variable skill reward pool credit meter datastore 1610 (represented as a pool or tank) in accordance with an incoming credits process f' 1608 executed by the skill reward controller. The incoming credits process f' receives credit wagering data of amounts of credits being wagered, won and lost from one or more interactive applications implementing a skill-based wagering proposition, a chance-based wagering proposition, and/or a combined wagering proposition interactive application in the form of a wagering game 1612 as described herein. The credit wagering data includes, but is not limited to, amounts of credits of gross gambling revenues (GGR) 1600 and amounts of credits that are committed to wagering (coin in) 1606 in the wagering game 1612. The f' process determines an amount of credits to add to the variable skill reward pool credit meter datastore 1606 based one or one or more factors, including but not limited to, a percentage of GGR for one or more skill-based wagering proposition games, chance-based wagering proposition games, and/or combined wagering proposition games implemented by the one or more interactive applications, a percentage of the GGR generated during a gaming session of an individual user during game play, and percentage of the amount of credits wagered in the game session.

The amount of credits committed to wagering are in accordance with a combination 1614 of skillful play by the user of a skill-based game having a skill proposition presented to the user by an interactive application of an interactive controller as described herein, and in accordance with a random number generator and a paytable that generate chance-based wager outcomes in the form of amounts of credits 1618 that may be awarded to a user for achieving one or more skill objectives during skillful play of the skill-based game having a combined wagering proposition as described herein. The amounts of credits awarded to the user for achieving the one or more skill objectives are awarded to the user as a portion of payouts or pays 1616.

In addition to the payouts or pays that a user earns through achieving skill objectives during skillful play of the skill-based game, additional amounts of credits 1620 may be added to a payout or pay 1616 to a user as an amount of credits of a variable skill reward from the variable skill reward pool credit meter datastore 1610 on the basis of an outgoing credits process f" 1622 executed by the skill reward controller. The outgoing credits process f" accepts as an input a number of factors, including but not limited to, variable skill reward pool credit meter datastore factors $m^p$ 1624 and game credit factors $m^g$ 1626. The game credit factors include, but are not limited, to a wagering credit denomination or "denom", (such as example embodiments 25¢, $1, etc.), an amount of committed credits wagered or wager size, and one or more skill achievement metrics. The variable skill reward pool credit meter datastore factors include, but are not limited to, an amount of credits accumulated in the variable skill reward pool credit meter datastore, and a rate of change in time of the amount of credits in the variable skill reward pool credit meter datastore. In some embodiments, an amount of credits that are a portion of the amount of credits in the variable skill reward pool credit meter datastore are paid out as a prize in any given pay are determined by a processing using a combination of factors, such as but not limited to, data regarding variable skill reward pool credit meter datastore metrics of Meter "p" Data regarding game, Meter "g" mg, and random outcomes from a random number generator and paytables or math tables.

In some embodiments, credit wagering data for a plurality of games are received by the variable skill reward controller, as indicated by functions 1628 and 1630, and used to add credits to the variable skill reward pool credit meter datastore 1610.

In various embodiments, a user of a game having a combined wagering proposition is awarded a fixed award of an amount of credits for achieving one or more skill objectives of a skill proposition where a probability that the user will be able to achieve the one or more skill objectives is inversely proportional to the fixed award of an amount of credits such that the more difficult the one or more skill objectives are, the higher the fixed award of an amount of credits awarded to the user. The one or more skill objectives are randomly selected using a random outcome of a random number generator. The random outcome is mapped to various parameters and rule sets of skill objectives having varying difficulties to create a skill proposition of the combined proposition. Accordingly, the random outcome determines a difficulty of the one or more skill objectives but not the fixed award of an amount of credits awarded to the user for achieving the one or more skill objectives and it is up to the skill of the user to achieve the one or more skill objectives of the skill proposition and be awarded the fixed award of an amount of credits associated with the one or more skill objectives. In addition to the fixed award of credits for achieving the skill objectives, the user is also awarded a variable skill award based on a skill metric determined during the user's gameplay of the game having the combined wagering proposition.

In an example embodiment, an interactive application provides a skill-based puzzle piece drop game to a user, and the user is awarded with variable amounts of credits of chance-based outcomes for achieving skill objectives of positioning dropped puzzle pieces composed of squares to complete rows within a frame having room for a finite number of partially filled rows. The user lines up groups of blocks in various shapes to create a completely filled row. Once the row is filled, the row is removed from the frame to make room for additional rows. A partial row is not removed. Eventually the user fails to complete enough rows and the partially filled rows completely fill the frame, and the game session is over. A variable skill reward for the user is provided if a skill metric determined for the user during the user's skillful play meets a specified threshold, such as but not limited to, filling a specified number of rows.

In another example embodiment, a skill proposition is implemented in a first person shooter style skill-based game provided by an interactive application. The skill-based game has skill objectives in the form of opponents that are engaged by the user. Some opponents stay engaged until they are defeated. If a user achieves a skill objective by defeating an opponent, the user is awarded an award of credits based on a random outcome. A variable skill reward for the user is provided if a skill metric determined for the user during the user's skillful play meets a specified threshold, such as but not limited to, if the user defeats a specified number of opponents, then the user is awarded the variable skill reward. In one such embodiment, at the start of each level, the random outcome randomly determines the type of opponents that appear. There are opponents that cannot be defeated; there are opponents that will automatically defeat the user if the user shoots them, but the user doesn't know which opponent they are dealing with; on some levels, no defeatable opponents appear; etc. Sometimes a skillful user will only be able to defeat a few opponents before an opponent defeats the user and be awarded a minimal amount of credits; sometimes a skillful user will be able to defeat a few opponents and the user will be awarded an amount of credits such the user breaks even or makes a little bit more than an amount of credits wagered; and sometimes a skillful user will be able to kill a high level opponent and dozens of lower level opponents and the user will be awarded significant amount of credits. An unskilled user may get the chance to defeat the highest level opponent, but because the user isn't skillful enough to defeat the highest level opponent, the user is awarded no credits.

In another example embodiment, a pinball-style video game is provided as a skill-based game by an interactive application executed by an interactive controller. The base skill objective of the skill-based game is to strike targets, sometimes referred to as toys, in a playing table of the pinball game using a pinball directed by the user using paddles or flippers. The user wagers credits against the user's skillful play of the skill-based game. The user is awarded points for each target struck as a skill metric. When the skill metric reaches one or more specified levels, the user is awarded with corresponding one or more variable skill reward awards in amounts of credits. In various embodiments, one or more chance-based outcomes are associated with one or more skill objectives that are represented as targets in the playing table of the video pinball game such that the user must strikes the targets to collect the credits associated with chance-based wager outcomes.

In other embodiments, a skill enhancer is introduced into the video pinball game as a ball save feature. As the user plays the skill-based game of the video pinball game, the user will eventually miss striking the pinball with the flippers or paddles, thus losing the pinball as an intermediate loss. The pinball is returned to the user on the basis of a random outcome as a skill enhancer, thus enabling the user to complete the base skill objective of the skill-based game of accumulating enough points in a skill metric to be awarded the variable skill reward award of an amount of credits.

In another embodiment, a racing game is provided as a skill-based game of an interactive application of an interactive controller. A user wagers on the user's skill in overtaking non-player characters during a simulated race. During the simulated race, a user is presented with one or more skill-objectives of overtaking an opponent non-player character in the form of another racer. The one or more skill-objectives are associated with credits of respective one or more chance-based outcomes. The characteristics of the non-player character are determined using a random outcome as described herein. If the user is able to overtake and pass the opponent non-player character, the user is awarded a chance-based wager outcome of an amount of credits associated with the skill objective. In another such embodiment, the user wagers on their skill in navigating around a course by a set amount of time. As the user navigates around the course to complete the course, skill disruptors are randomly introduced into the racing game in the form of obstacles. Some obstacles cause the user to crash regardless of the skill of the user, that is the obstacles are skill disruptors having a probability of 0 that the user can skillfully achieve the skill objective of overcoming the skill disruptor. In various embodiments, a skill enhancer is randomly introduced as described herein that enables the user to complete a skill-objective, such as, but not limited to, fuel for a vehicle being raced by the user. Without the skill enhancer, the user is unable to complete a skill objective such that the user is awarded a fixed award of an amount of credits. A variable skill reward for the user is provided if a skill metric determined for the user during the user's skillful play meets a specified threshold, such as but not limited to, an amount of time taken to complete the simulated race course.

In an example embodiment, a word creation game is provided. In the word creation game, a user is presented with a user interface having a 4×4 grid of 16 cells displayed on a touchscreen display having a random selection of letters located in the cells, with one letter per cell. The user spells words using the letters on the user interface by connecting the letters through swiping a finger over the displayed letters. A variable skill award is awarded to a user based on skill metric including but not limited to the user spelling a mystery word. Every round one of the possible words on the grid of the user interface becomes a "mystery word". If the user spells the mystery word, they win the variable skill award. In some embodiments, every game without a successful discovery of the mystery word increases the variable skill award. In one example embodiment, there are between 300 and 400 words possible on a typical grid of the user interface, accordingly the variable skill award can grow to a substantial amount. In some embodiments, a user may be given a hint as to what the mystery word is, thus increasing the chance that the user may be able to find the mystery word. In an example embodiment, the hint is an indication of a number of letters the mystery word has (e.g. "4 letter mystery word!"). In several embodiments, the mystery word is revealed at the end of the game.

In another example embodiment, a matching game is provided wherein a user matches three or more symbols that are adjacent to each other on a playing field of a user interface. The symbols are ranked into a hierarchy of symbol levels and matching symbols causes one of the matched symbols to be elevated a level within the hierarchy into a higher level symbol. In one such embodiment, the symbols represent animals and matching animals in order to raise them a level is termed "evolving" within the game. The symbols are displayed on a user interface having a rectangular grid of tiles with the symbols located in the tiles, one symbol per tile. During game play, a random tile is selected by the gaming system and the user has a specified number of turns to evolve a symbol on that exact tile as a skill metric used to determine if the user can be awarded a variable skill award. In some embodiments, symbols, and the symbol evolved in the specified tile, are required to be of a specified level within the hierarchy of symbols. In some embodiments, the variable skill award is funded by taking a percentage of each wager commitment.

In another example embodiment, a skill metric in the form of a value is incremented each time a match is made of a specific type of symbol. A user has as a specified amount of time to make matches of the specific type of symbol in order to trigger a variable skill award. In one such embodiment, the symbols represent colored fruit and the user must match multiple fruit symbols of the same color. Progress toward matching the colored fruit is represented as a blender that fills up as the fruit symbols are matched.

In another example embodiment, a skill-based game is provided having a user interface including a touchscreen. A user is presented with virtual objects that the user must cut up into pieces by swiping or slicing using the user's finger in a swiping or slicing motion on the touchscreen. During gameplay, as a skill metric, a specified virtual object appears that is difficult to completely cut up; however, if the user is successful in cutting up the virtual object, the user is awarded a variable skill award. In one such an embodiment, the virtual object is a big cake, and the user has a limited time to madly swipe the cake and win the variable skill award.

In another example embodiment, a catapult-style skill-based game is provided where a skill objective is to launch virtual projectiles at virtual targets using a catapult-like virtual projectile launcher. The skill-based game includes levels with an arrangement of virtual targets. A variable skill award level is provided having a skill metric of hitting a set of virtual targets that is determined by challenging the user to hit the set of virtual targets using a limited number of virtual projectiles. In various such embodiments, one or more virtual targets in a level have one or more associated chance-based wager outcomes. For each virtual target struck, the user is awarded one or more chance-based wager outcomes. When the user misses a virtual target, any chance-based wager outcomes associated with the virtual target are allocated to a variable skill award. In some embodiments, the skill award level is provided to the user during a game based on a random outcome of a random number generator.

In some embodiments, skill advantages are provided to the user during normal level gameplay, such as a "power up". These skill advantages are not provided during the skill award level gameplay.

In some embodiments, an infinite-runner style skill-based game is provided to the user. One or more skill objectives are provided in the game world of the skill-based game in the form of "missions" that the user must complete. Fixed amount skill-based wager outcomes are provided to the user for successfully achieving a skill objective. Each time a user fails to achieve a skill objective, an amount of a variable skill award is incremented. As a skill metric determination process, a variable skill award skill objective is presented to the user and, if the user successfully achieves the variable skill award skill objective, the user is awarded a variable skill award.

In some such embodiments, gameplay of the infinite runner style skill-based game includes piloting a low flying virtual vehicle in third person perspective through a game world having obstacles. One or more skill objectives are provided in the form of "missions." The missions include, but are not limited to, collecting a specified number of virtual objects, and traveling a specified virtual distance within the game world in a specified amount of time. A variable skill reward for the user is provided if a skill metric determined for the user during the user's skillful play meets a specified threshold, such as but not limited to, collecting a specified number of virtual objects, and traveling a specified virtual distance within the game world in a specified amount of time.

In some such embodiments, gameplay of the infinite runner style skill-based game includes a first person perspective of running through a game world populated by virtual zombies. During gameplay, the user uses virtual weapons to strike the virtual zombies thus "killing" the virtual zombies, or the user may choose to try and avoid the virtual zombies. One or more skill objectives are provided in the form of "missions." The missions include, but are not limited to, collecting a specified number of virtual objects, striking a specified number of virtual zombies, striking a specified number of zombies with a specified virtual weapon, and traveling a specified virtual distance within the game world. A variable skill reward for the user is provided if a skill metric determined for the user during the user's skillful play meets a specified threshold, such as but not limited to, collecting a specified number of virtual objects, striking a specified number of virtual zombies, striking a specified number of zombies with a specified virtual weapon, and traveling a specified virtual distance within the game world.

In some such embodiments, gameplay of the infinite runner style skill-based game includes piloting a low flying character in a side scrolling perspective through a game world having obstacles. One or more skill objectives are provided in the form of "missions." The missions include, but are not limited to, collecting a specified number of virtual objects, and traveling a specified virtual distance within the game world in a specified amount of time. A variable skill reward for the user is provided if a skill metric determined for the user during the user's skillful play meets a specified threshold, such as but not limited to, collecting a specified number of virtual objects, and traveling a specified virtual distance within the game world in a specified amount of time.

In another example embodiment, a pinball-style skill-based game is provided where a skill objective is to strike a virtual pinball with virtual paddles such that the virtual pinball strikes virtual targets within a virtual pinball game. One or more of the virtual targets are associated with one or more chance-based wager outcomes. For each virtual target struck, the user is awarded one or more chance-based wager outcomes. When the user misses a virtual target, any chance-based wager outcomes associated with the virtual target are allocated to a variable skill award pool. A skill metric determination process includes a variable skill award objective being provided where the user is challenged to hit one or more specified virtual targets within a specified amount of time. In some embodiments, the variable skill award objective is provided to the user during a game based on a random outcome of a random number generator. In some such embodiments, the variable skill award objective is to strike virtual targets in the form of unlighted letters that when struck, light up and spell a specified word.

In another example embodiment, a skill-based game is an arcade-style game where a user pilots a virtual vehicle having a virtual weapon that fires virtual projectiles within a two-dimensional game world filed with moving virtual targets that, when struck by a virtual projectile, destruct. During gameplay, the user collects virtual objects within the game world by striking the virtual objects with the virtual vehicle. Once a specified number of virtual objects are collected, a skill metric determination process includes presenting the user with a variable skill objective of collecting another specified number of virtual objects within a specified period of time.

In another example embodiment, a skill-based game includes making virtual hands from a virtual cards dealt from a virtual deck of cards. A skill metric determination process includes determining a specific combinations of virtual cards that the user is to collect into their virtual hand are specified as a variable skill award objective.

While the above description may include many specific embodiments of the invention, these should not be construed as limitations on the scope of the invention, but rather as examples of embodiments thereof. It is therefore to be understood that the invention can be practiced otherwise than specifically described, without departing from the scope and spirit of the invention. Thus, embodiments of the invention described herein should be considered in all respects as illustrative and not restrictive.

What is claimed:

1. A variable skill reward wagering system, comprising:
- an interactive controller, wherein the interactive controller is configured to:
  - provide a skill-based game;
  - generate a graphical display of the skill-based game using a display output device;
- determine a skill outcome for a user while playing the skill-based game;
  - distribute the skill outcome to a process controller;
  - receive from the process controller a variable skill reward of credits; and
  - update the graphical display to display the variable skill reward of credits;
- a variable skill reward controller, wherein the variable skill reward controller is configured to:
  - determine an amount of credits to add to a variable skill reward pool credit meter datastore;
  - receive the skill outcome for the user from the process controller; and
  - determine the variable skill reward of credits from the variable skill reward pool credit meter datastore for the user based on the skill outcome; and
- the process controller configured to communicate with the interactive controller and the variable skill reward controller, wherein the process controller is further configured to:
  - receive the skill outcome from the interactive controller;
  - distribute the skill outcome to the variable skill reward controller; and
  - receive the variable skill reward of credits from the variable skill reward controller.

2. The variable skill reward wagering system of claim 1, wherein the interactive controller and the process controller are configured from the same device.

3. The variable skill reward wagering system of claim 1, wherein the process controller and the variable skill reward controller are configured from the same device.

4. The variable skill reward wagering system of claim 1, further comprising:
- an enclosure constructed to mount:
  - a user input device operatively connected to the interactive controller;
  - a user output device operatively connected to the interactive controller;
  - a credit input device operatively connected to the process controller; and
  - a credit output device operatively connected to the process controller.

5. The variable skill reward wagering system of claim 4, further comprising a random number generator, wherein the process controller is further configured to:
- determine a skill proposition of the skill-based game based on a random outcome generated by the random number generator;
- distribute the skill proposition to the interactive controller; and communicate with the credit output device to generate a credit output based on the variable skill reward of credits, and wherein the interactive controller is further configured to:

receive the skill proposition from the process controller;

generate a user presentation based on the skill proposition;

detect user interactions with the user presentation;

determine the skill outcome based on the user interactions and the skill proposition; and distribute the skill outcome to the process controller.

* * * * *